US011819150B2

(12) United States Patent
Vazquez

(10) Patent No.: US 11,819,150 B2
(45) **Date of Patent: *Nov. 21, 2023**

(54) HANDLED HOLDER FOR CUPS, CONTAINERS, AND THE LIKE

(71) Applicant: Andre Xavier Vazquez, North Chicago, IL (US)

(72) Inventor: Andre Xavier Vazquez, North Chicago, IL (US)

( * ) Notice: Subject to any disclaimer, the term of this patent is extended or adjusted under 35 U.S.C. 154(b) by 11 days.

This patent is subject to a terminal disclaimer.

(21) Appl. No.: 17/728,452

(22) Filed: Apr. 25, 2022

(65) Prior Publication Data

US 2022/0240700 A1 Aug. 4, 2022

Related U.S. Application Data

(63) Continuation of application No. 16/800,446, filed on Feb. 25, 2020, now Pat. No. 11,311,127.

(60) Provisional application No. 62/810,495, filed on Feb. 26, 2019.

(51) Int. Cl.

| | |
|---|---|
| ***B65D 25/34*** | (2006.01) |
| ***A47G 23/02*** | (2006.01) |
| ***B65D 25/28*** | (2006.01) |
| ***B65D 81/38*** | (2006.01) |

(52) U.S. Cl.

CPC ..... *A47G 23/0216* (2013.01); *B65D 25/2814* (2013.01); *B65D 81/3876* (2013.01); *A47G 2023/0291* (2013.01)

(58) Field of Classification Search

CPC ..... A47G 23/0216; A47G 2023/0291; B65D 25/2814; B65D 25/22; B65D 81/3876

USPC ..... 220/737, 738, 739, 239

See application file for complete search history.

(56) References Cited

U.S. PATENT DOCUMENTS

| | | | | |
|---|---|---|---|---|
| 1,795,615 | A * | 3/1931 | Parran | A47G 23/0216 229/400 |
| 1,866,805 | A | 7/1932 | Haywood | |
| 4,685,583 | A | 8/1987 | Noon | |
| 4,715,633 | A | 12/1987 | Brink et al. | |
| 5,320,249 | A | 6/1994 | Strech | |
| 5,454,484 | A | 10/1995 | Chelossi | |
| 6,360,913 | B1 | 3/2002 | Bruinsma et al. | |
| 6,557,751 | B2 | 5/2003 | Puerini | |
| D485,133 | S | 1/2004 | Breeze-Stringfellow | |
| D590,211 | S | 4/2009 | Mancha et al. | |
| D640,508 | S | 6/2011 | Bouillon | |
| 8,210,392 | B2 | 7/2012 | Kang et al. | |
| D720,576 | S | 1/2015 | Dresner | |
| D720,577 | S | 1/2015 | Gallegos | |
| 9,119,491 | B2 | 9/2015 | Robbins, III | |
| D744,292 | S | 12/2015 | Terzian | |

(Continued)

FOREIGN PATENT DOCUMENTS

| | | |
|---|---|---|
| KR | 101707467 B1 | 2/2017 |

*Primary Examiner* — John K Fristoe, Jr.
*Assistant Examiner* — Elizabeth J Volz
(74) *Attorney, Agent, or Firm* — FOLEY & LARDNER LLP

(57) ABSTRACT

A cup holder that includes a sleeve, which is expandable from a flat position to an open position, in which the sleeve is configured to receive a cup; and a handle having first and second ends coupled to the sleeve to form a loop, wherein at least one perforation associated with at least one of the first and second ends of the handle provides for adjustability of the loop relative to the sleeve.

20 Claims, 20 Drawing Sheets

(56) References Cited

U.S. PATENT DOCUMENTS

| | | | | |
|---|---|---|---|---|
| D774,836 | S | 12/2016 | Bussey et al. | |
| D799,279 | S | 10/2017 | Mcgraw | |
| 11,311,127 | B2 * | 4/2022 | Vazquez | B65D 25/2814 |
| 2003/0071045 | A1 | 4/2003 | Taylor | |
| 2004/0200943 | A1 | 10/2004 | Rokov | |
| 2004/0232156 | A1 | 11/2004 | Hogan et al. | |
| 2005/0001126 | A1 | 1/2005 | Breeze-Stringfellow | |
| 2006/0086745 | A1 | 4/2006 | Morrison | |
| 2006/0102637 | A1 | 5/2006 | Robertson et al. | |
| 2008/0035819 | A1 | 2/2008 | Garfin et al. | |
| 2010/0200603 | A1 | 8/2010 | Kim et al. | |
| 2012/0228318 | A1 | 9/2012 | Martin et al. | |
| 2013/0200090 | A1 * | 8/2013 | Dickert | B65D 81/3876 220/739 |
| 2015/0164256 | A1 | 6/2015 | Helton | |
| 2017/0273485 | A1 | 9/2017 | Rao | |

* cited by examiner

HANDLED HOLDER FOR CUPS, CONTAINERS, AND THE LIKE

CROSS REFERENCE TO RELATED APPLICATIONS

This application is a continuation of U.S. application Ser. No. 16/800,446, filed Feb. 25, 2020, which claims the benefit of U.S. Provisional Patent Application No. 62/810,495, filed on Feb. 26, 2019. Each of the foregoing applications are incorporated by reference herein in their entireties.

BACKGROUND

The present application relates generally to the field of holders for cups, containers, and the like for coffee, tea, and other hot beverages. More specifically, this application relates to such holders having a handle integrated with a sleeve that makes carrying the cup, container, etc. via the holder easier and safer compared to conventional coffee sleeves.

SUMMARY

At least one embodiment of this application relates to a cup holder that includes a sleeve and a handle. The sleeve is expandable from a flat position to an open position, in which the sleeve is configured to receive a cup, container, or the like. The handle has first and second ends coupled to the sleeve to form a loop, wherein at least one perforated element associated with one of the first and second ends of the handle provides for adjustability of the loop relative to the sleeve.

At least one embodiment of this application relates to a cup holder that includes a sleeve and a handle. The sleeve is expandable from a flat position to an open position, in which the sleeve is configured to receive a cup. The handle includes a first end coupled to a first portion of the sleeve, a second end coupled to a second portion of the sleeve, and an intermediate section extending between the first and second ends. The first portion is adjacent to a first edge of the sleeve, and the second portion is adjacent to a second edge of the sleeve. At least one of the first portion or the second portion is defined by a first perforation, which extends inwardly from the associated edge of the sleeve at a first location, and a second perforation, which extends inwardly from the associated edge of the sleeve at a second location.

At least one embodiment of this application relates to a cup holder that includes a sleeve and a handle. The sleeve that is expandable from a flat position to an open position, in which the sleeve is configured to receive a cup. The handle includes first and second ends coupled to first and second portions of the sleeve, respectively, to form a loop. The first portion is adjacent to a first edge of the sleeve and is defined by a first perforated element, and the second portion is adjacent to a second edge of the sleeve and is defined by a second perforated element. Each of the first and second perforated elements is adjustably separable from a base of the sleeve to adjust the loop relative to the base of the sleeve.

BRIEF DESCRIPTION OF THE FIGURES

The disclosure will become more fully understood from the following detailed description, taken in conjunction with the accompanying figures, wherein like reference numerals refer to like elements.

DETAILED DESCRIPTION

Before turning to the Figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the Figures, disclosed herein are holders (e.g., cup holders, sleeves, jackets, retainers, carriers, etc.) for carrying/holding cups and other beverage containers. The holders provide thermal insulation while making it easier to carry the cup by having an adjustable handle that can be modified (e.g., adjusted, configured, etc.), such as to have a different shape and/or size, to fit the person carrying the holder. The adjustability is provided through one or more perforated elements (e.g., perforations, perforated sections, perforated portions, perforated cuts, etc.), where each perforated element is configured as having a plurality (e.g., a series) of spaced apart holes, punctures, notches, or the like that pass completely through or part way through the thickness of the holder in the area of the perforated element. Each perforation can be circular or elongated and the spacing between each pair of adjacent perforations can differ.

Figure 1:
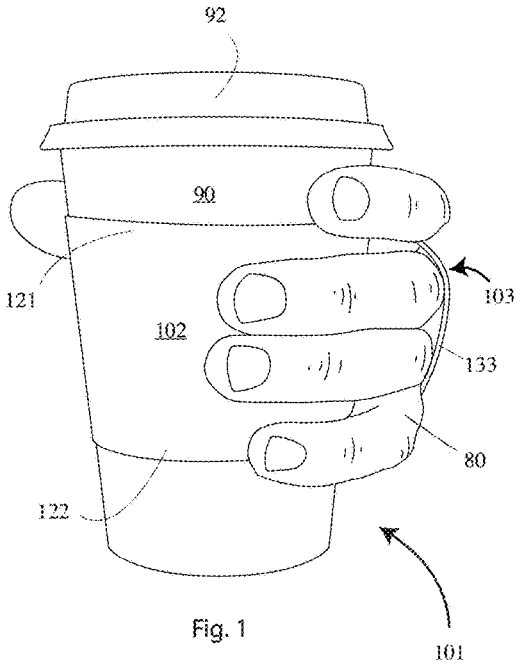
FIG. 1 is a front perspective view of an embodiment of a cup holder shown holding a cup and being grasped by a hand.
Figure 2:
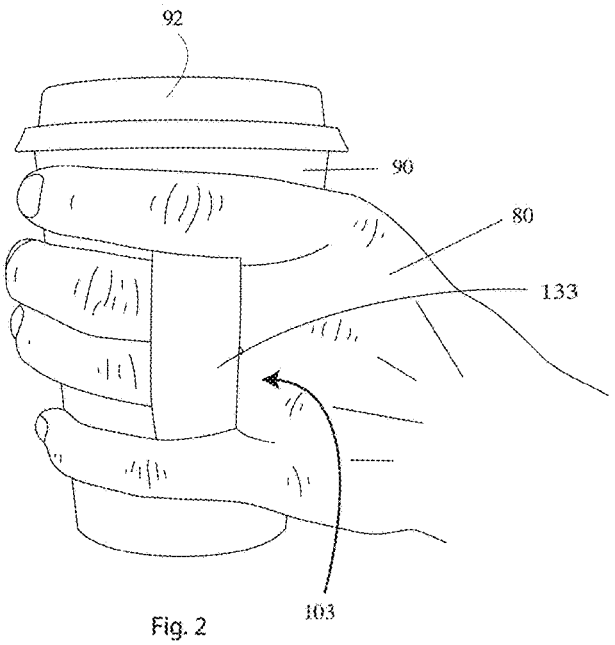
FIG. 2 is a side perspective view of the cup holder shown in FIG. 1.
Figure 3:
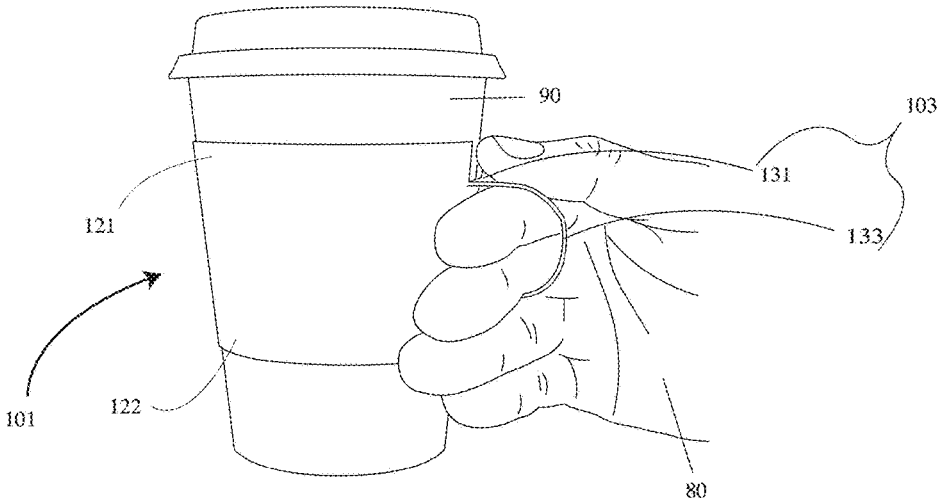
FIG. 3 is another perspective view of the cup holder shown in FIG. 1.

FIGS. 1-7 illustrate an embodiment of a holder 101 for carrying (e.g., holding, retaining, etc.) a cup 90 for coffee, tea, and other hot/cold beverages, as shown in FIGS. 1-3, although the holder 101 can hold other types of cups, containers, packages, and the like for any suitable beverage/liquid. A lid 92 is shown covering the open top of the cup 90, but it is noted that the holder 101 can be used with cups not having lids, since the holders of this application make it easier to carry the cup without spilling the contents (e.g., onto the person holding the holder 101). The illustrated holder 101 includes a sleeve 102 and a handle 103, which allow a user to carry the cup 90 through the holder 101, such as by positioning one or more fingers of one's hand 80 through the handle 103 while wrapping the palm of the hand 80 around the sleeve 102. As shown in FIGS. 1 and 2, the middle and ring fingers of the hand 80 are positioned within the loop between the handle 103 and the sleeve 102 with the palm. As shown in FIG. 3, the index and middle fingers of the hand 80 pass through the loop between the handle 103 and the sleeve 102, with the palm facing outwardly away from the holder 101. The configuration (e.g., size, shape, position relative to the sleeve, etc.) of the handle 103 is adjustable so that a person can tailor the configuration to one's preference (e.g., comfort, ease to carry, etc.), such as in the manners shown in FIGS. 1-3.

The illustrated sleeve 102 has a hollow frusto-conical shape that is configured to hold or retain a cup (e.g., the cup 90). The sleeve 102 tapers inwardly (e.g., narrows) moving from a first side 121 (shown as a top side) to a second side 122 (shown as a bottom side) so that the sleeve 102 can slide over and retain different sized cups. The height of the sleeve 102 (i.e., a distance between the first and second sides 121, 122), as well as the thickness of the sleeve 102, can be larger or smaller than what is shown.

Figure 5:
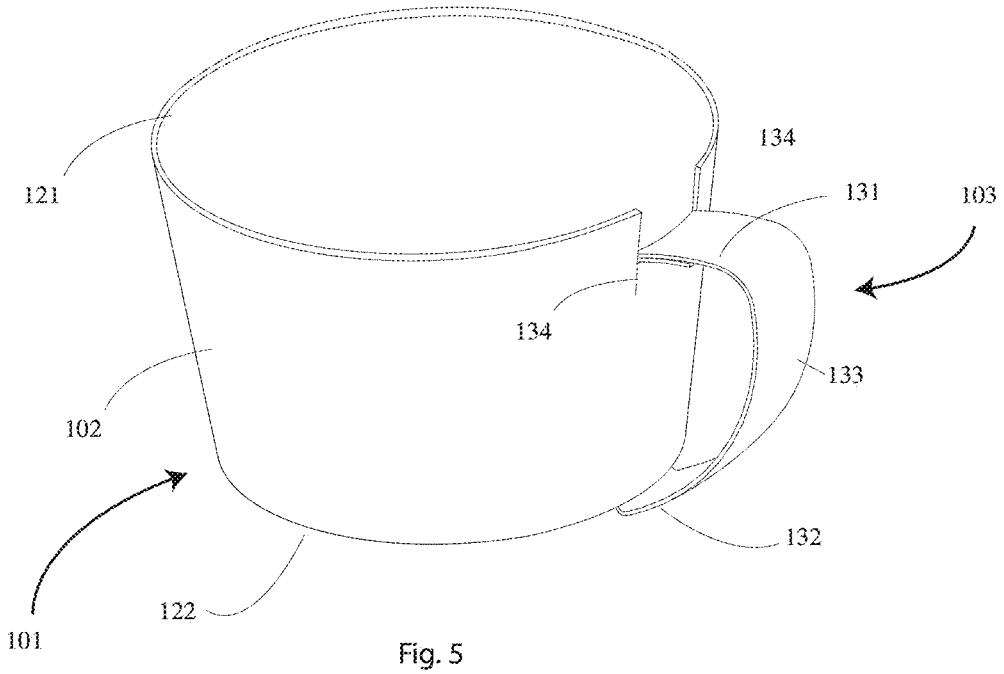
FIG. 5 is a perspective view of the cup holder shown in FIG. 4.

The handle 103 and the sleeve 102 can be integrally formed together to form a loop (e.g. a loop shaped element) for receiving one or more fingers of a person carrying the holder 101. Alternatively, the handle 103 and the sleeve 102 can be formed separately from one another, then coupled together to form the loop. As shown in FIG. 5, the handle 103 includes a first/upper end portion 131, which couples to the sleeve 102 proximate the first side 121, a second/lower end portion 132, which couples to the sleeve 102 proximate the second side 122, and an intermediate portion 133 extending between and interconnecting the first and second end portions 131, 132. The handle 103 is adjustable relative to the sleeve 102, such as through one or more perforations, to change the size/shape of the loop, so that the loop is adjustable to one's preference (or perforated elements). For example, one or more perforations (e.g., in the sleeve 102) can define one or both of the end portions 131, 132 to provide such adjustability. FIG. 5 shows two perforations 134 defining the sides of the first end portion 131, which extends away from the sleeve 102 generally in a transverse or flat manner, and without any perforations defining the second end portion 132, which is more arcuate in shape. This arrangement advantageously provides increased stability, such as to the fingers above/below the handle 103 (e.g., first end portion 131), to support weight and is easier to control than other holders.

The holder 101 (e.g., the sleeve 102 and/or the handle 103) can be made from or include any suitable material that provides thermal insulation and is flexible enough to be manipulated (e.g., rearranged, reconfigured, etc.) by a person, so as to change the shape of the holder 101 (e.g., through folds, perforations, etc.). By way of non-limiting examples, the holder 101 can be made from or include a corrugated paper, cardboard, fiberboard, kraft-paper, or other similar material. It is noted that the sleeve 102 and the handle 103 can be made of or include the same material or different materials.

Figure 4:
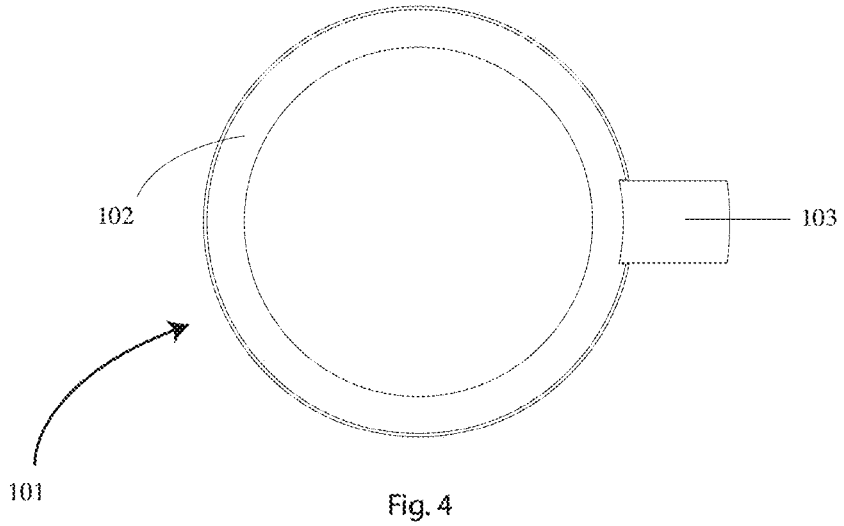
FIG. 4 is a top view of the cup holder shown in FIG. 3 without the cup.
Figure 6:
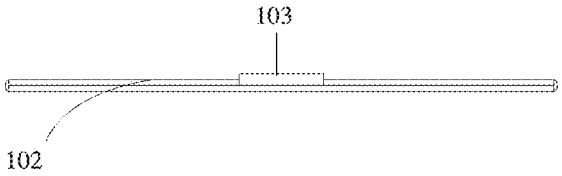
FIG. 6 is a top view of the cup holder shown in FIG. 3 in the flat.
Figure 7:
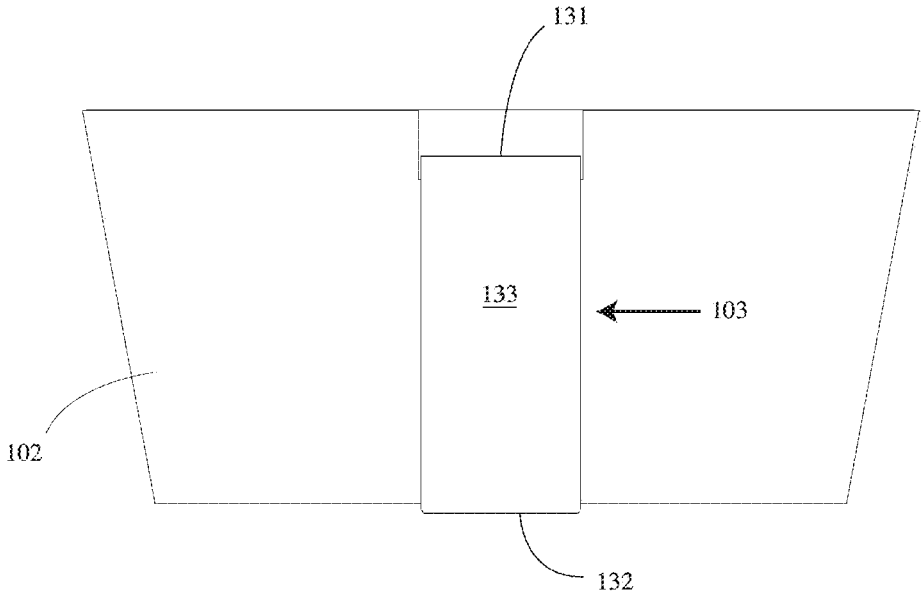
FIG. 7 is a plan view of the cup holder shown in FIG. 6.

The assembled holder 101 can be manipulated between a flattened arrangement (e.g., flat position), such as shown in FIGS. 6 and 7, and an open arrangement (e.g., open position), such as shown in FIGS. 4 and 5. In the flattened arrangement, sides of the sleeve 102 are in contact with one another, such that the sleeve 102 is substantially flat (FIG. 6). The handle 103 can be substantially flat as well. In the open arrangement, the sides of the sleeve 102 are separated from one another, such that the sleeve 102 forms a frusto-conical shape to receive a cup or other container (FIG. 5). The handle 103, which is adjustable, can be in any position (e.g., ranging from a flat position to a fully open position, such as when all of the perforated elements have been torn all the way through). Notably the holder 101 can be manipulated into an intermediate (e.g., partially open) arrangement that is between the flattened and open arrangements.

FIGS. 8-13 illustrate various embodiments of holders in the flat arrangement or position prior to forming (e.g., folding, adhering, perforating, manipulating, etc.) into assembled or finished holders, such as, for example, the holder 101 shown in FIGS. 1-7. It is noted that in FIGS. 8-13, 14-26, 30 and 31, fold lines are illustrated using center lines (long dash, short dash, long dash; or dot-dash), perforated elements or cuts are illustrated using equal length dashed lines (dash, dash; or dash-dash etc.), and adhesive (e.g., glue) is illustrated using a thicker solid or stippled line. Some fold lines are labeled (e.g., with "FL"), but not all fold lines are labeled.

Figure 8:
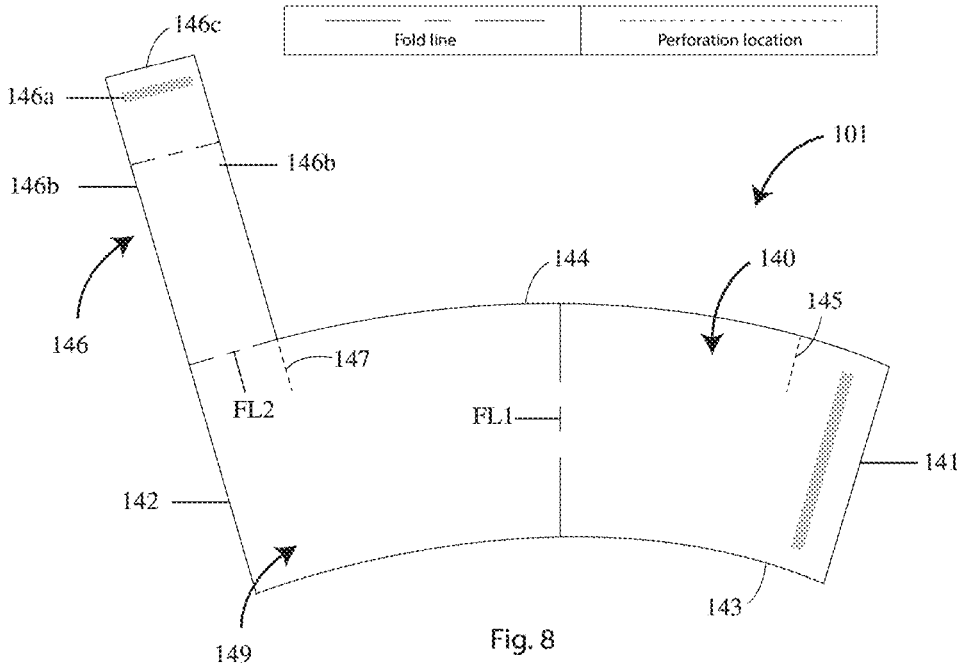
FIG. 8 is a plan view of a cup holder in the flat and prior to assembly into the cup holder shown in FIG. 5.

The holder 101 is shown in FIG. 8 having a base 140, which forms the sleeve (e.g., the sleeve 102), and an arm 146, which extends from the base 140 to form the handle (e.g., the handle 103). The illustrated base 140 has a generally arcuate or curved shape that extends generally in a first (e.g., lateral, width, etc.) direction from a first end/side 141 (shown as the right end/side) to a second end/side 142 (shown as the left end/side) and that generally extends in a second (e.g., vertical, height, etc.) direction from a bottom side 143 to a top side 144. The arm 146 is shown (in FIG. 8) extending away from an upper left corner of the top side 144 and as having a generally rectangular shape. The arm 146 includes a portion **146*a* that is configured to receive an adhesive or other adherent for coupling the portion 146*a* to another part of the holder 101 (e.g., part of the base 140). The adhesive portion 146*a* is shown as the top portion of the illustrated arm 146, where the top portion is defined by two opposite sides 146*b*, which extend to the top side 144 of the base 140, and an end 146*c*** (e.g., top).

The holder 101 includes one or more perforations that provide for an adjustable handle (e.g., the handle 103). The holder 101 illustrated in FIG. 8 includes a first perforation 145 and a second perforation 147. The first perforation 145 is shown located proximate to an upper right corner of the base 140 and extends inwardly, such as offset from the first side 141, from the top side 144 toward the bottom side 143 by a first distance. The second perforation 147 is shown located proximate to an upper left corner of the base 140. For example, the second perforation 147 is located proximate (e.g., collinear with) the inner side **146*b* of the arm 146 and extends inwardly into the base 140 from the top side 144 and inner side 146*b* toward the bottom side 143 by a second distance. Although the first and second distances of the perforations 145, 147 are shown substantially the same, the distances could be configured differently. The first perforation 145 is shown extending generally parallel to the first end 141 of the base 140 and the second perforation 147 is shown extending generally parallel to the second end 142 to form a generally rectangular shaped handle 103 after assembly (e.g., folding, gluing, etc.). The first and second perforations 145, 147 are configured to cooperate and define the adjustable first end portion 131 of the handle 103, and the first and second lengths of the perforations 145, 147 define the potential length that the second end portion 131 can be perforated (e.g., torn) away from the top or first side 121 of the sleeve 102. As shown in FIG. 8, the first and second distances are less than a height of the base 140 (e.g., less than the length of either end 141, 142) such that a non-perforated section 149 is disposed between each perforation 145, 147 and the bottom side 143. The perforated sections 145, 147 allow a user to adjust the configuration (e.g., length, shape, etc.) of the handle 103 by tearing along the perforation by a desired length. The non-perforated section 149 resists tearing to prevent tearing through the entire base 140, which could result in the handle becoming separated from the sleeve 102 and the ends of the sleeve 102** being disconnected.

The holder 101 shown in FIG. 8 can be assembled using a three step process. The first step involves applying an adhesive to the holder 101 at one or more locations. As shown in FIG. 8, adhesive is applied to the portion **146*a* of the arm 146 and along the first end 141 of the base 140 between the top and bottom sides 143, 145. The second step involves folding the base 140 about a first fold line FL1, which is located between the first and second ends 141, 142, by bringing the first and second ends 141, 142 together, so that a first section that is located between the first end 141 and the first perforation 145 overlaps with a second section that is located between the second end 142 and the second perforation 147. Further, adhesive is located between the overlapping first and second sections to adhere them together. The third step involves forming the handle by wrapping the end 146*c* of the arm 146 around the folded base 140 such that the adhesive on the end 146*c* secures the end 146*c* to the base 140. The arm 146 can be folded about a second fold line FL2 defined by where the arm 146 intersects (e.g., meets) the base 140, as shown in FIG. 8**. It is noted that these steps can be done in a different order as that set forth above. For example, applying adhesive can be done after folding.

Figure 9:
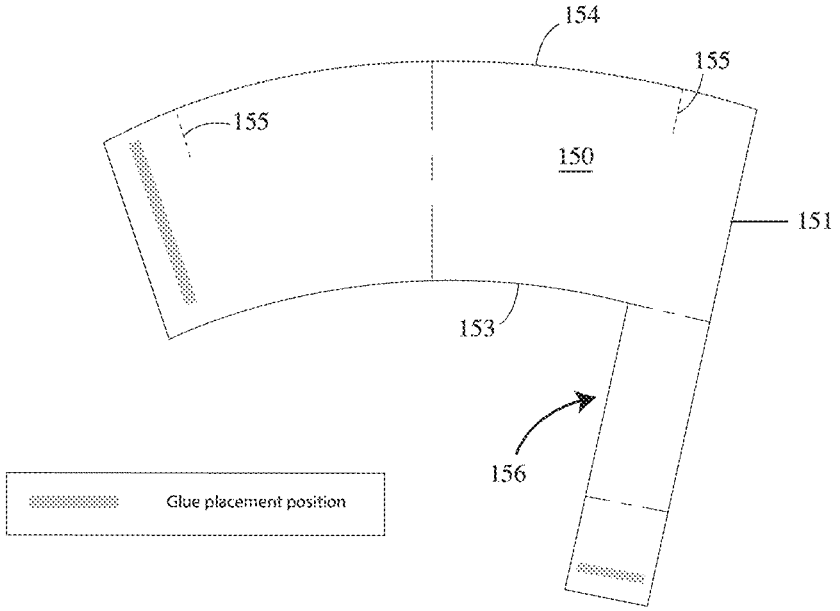
FIG. 9 is a plan view of a cup holder in the flat and prior to assembly into a cup holder, such as the cup holder shown in FIG. 5.

FIG. 9 shows another example of a flat work-piece that is configured to form a holder (e.g., the holder 101) when assembled. The overall shape of the flat work-piece is similar to the flat work-piece shown in FIG. 8, except an arm 156 extends downwardly from a bottom side 153 (rather than a top side 154, such as that shown in FIG. 8) proximate a first side 151 of a base 150. Two perforations 155 are provided in the base 150 at similar locations described above for the perforations 145, 147 of the holder shown in FIG. 8 (e.g., proximate upper right and left corners of the base 150, respectively). Further, the holder 101 shown in FIG. 9 can be assembled using a similar process, as described above.

Figure 10:
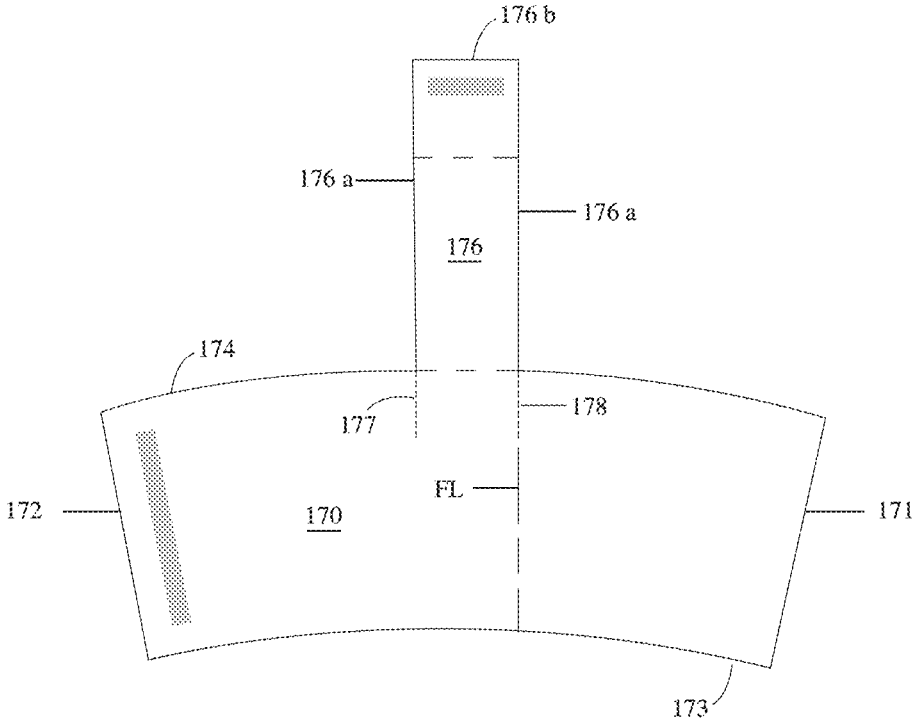
FIG. 10 is a plan view of a cup holder in the flat and prior to assembly into the cup holder, such as the cup holder shown in FIG. 5.

FIG. 10 shows another example of a flat work-piece that is configured to form a holder (e.g., the holder 101) when assembled and includes a base 170 and an arm 176, which extends upwardly from a central portion of the base 170 to form a handle. The base 170 is generally rectangular (e.g., arcuate) extending from a first side 171 to a second side 172 and extending from a bottom side 173 to a top side 174. The arm 176 extends between two sides **176*a*, which extend upwardly from the top side 174 of the base 170, to a top end 176*b*. A perforated element is disposed in the base 170 and includes a first side perforation 177 (e.g., left side) and a second side perforation 178 (e.g., right side). The first side perforation 177 extends collinear with one side 176*a* from the top side 174 toward the bottom side 173; and the second perforation 178 extends collinear with the other side 176*a* from the top side 174 toward the bottom side 173. During assembly, one of the first and second sides 171, 172 is folded about the fold line FL toward the other side of the base 170, and the top end 176*b* of the arm 176 is wrapped around to the bottom side 173 of the base 170 to form a handle. Adhesive is used to secure the overlapping first and second sides 171, 172 and the top end 176*b* of the arm 176 to the base 170**.

Figure 11:
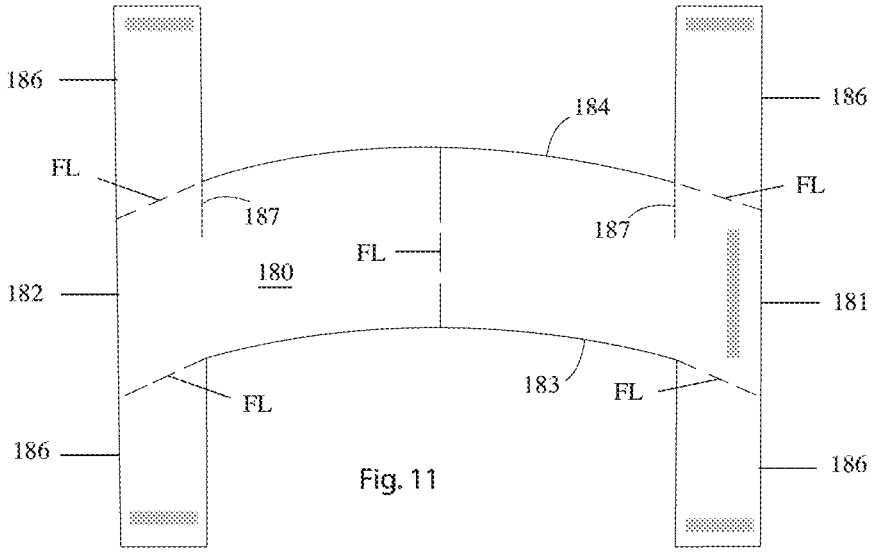
FIG. 11 is a plan view of a cup holder in the flat and prior to assembly into the cup holder, such as the cup holder shown in FIG. 5.

FIG. 11 shows another example of a flat work-piece that is configured to form a holder (e.g., the holder 101) upon assembly. The flat work-piece includes a base 180, which extends from a first side 181 to a second side 182 and from a bottom side 183 to a top side 184. The illustrated flat work-piece also includes an arm 186 disposed in each of the four corners of the base 180. That is first and second arms 186 extend upwardly from the top side 184 proximate each of the first and second ends 181, 182, and third and fourth arms 186 extend downwardly from the bottom side 183 proximate each of the first and second ends 181, 182. The arms 186 cooperate to form a handle after assembly. A perforation 187 extends from the top side 184 toward the bottom side 183 at the inner side of each upper arm 186 (i.e., the arms extending upwardly form the top side 184). During assembly, the base 180 is folded along the fold line FL, the sides 181, 182 are secured together with adhesive, and the two arms 186 are folded along the fold lines FL to overlap with the other arms 186 to form a handle. The perforations 187 can be utilized, as discussed herein, to adjust the handle configuration.

Figure 12:
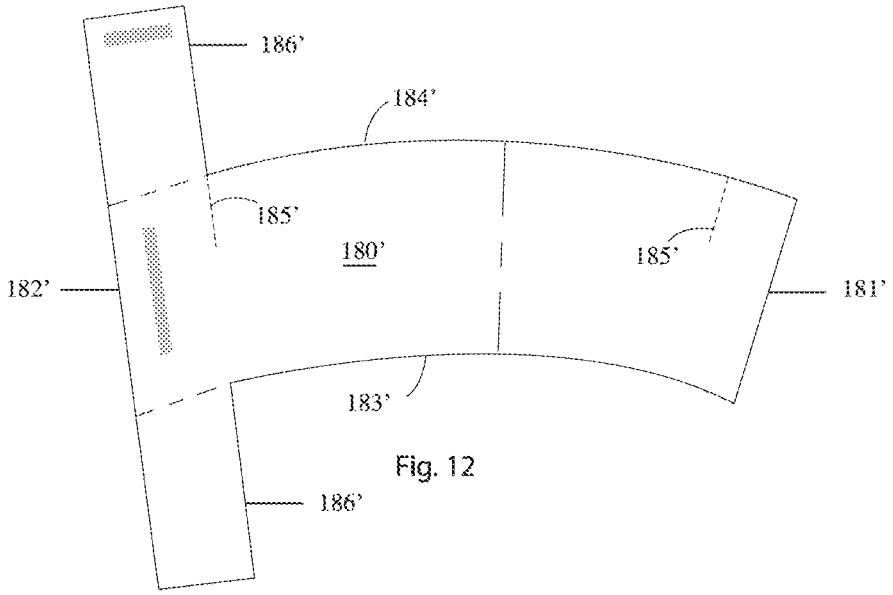
FIG. 12 is a plan view of a cup holder in the flat and prior to assembly into the cup holder, such as the cup holder shown in FIG. 5.

FIG. 12 shows another example of a flat work-piece that is configured to form a holder (e.g., the holder 101) when assembled. The illustrated flat work-piece has the same basic configuration as the work-piece shown in FIG. 11, except is missing the two arms proximate the first end 181'. Thus, the work-piece includes only the two arm 186' extending proximate the second end 182'. That is, a first arm 186' extends above the top side 184' of the base 180' and a second arm 186' extends below the bottom side 183' of the base 180'. Thus, no arms extend proximate the first end 181'. The perforations 185' are basically the same as described above, in that the perforations 185' extend downwardly from the top side 184' toward the bottom side 183'. The perforation 185' proximate the arms 186' can extend collinear with an inner edge of the upper arm 186', which can be collinear with an inner edge of the lower arm 186'. Further, the work-piece is assembled in a manner that is similar to that described above for the work-piece shown in FIG. 11.

Figure 13:
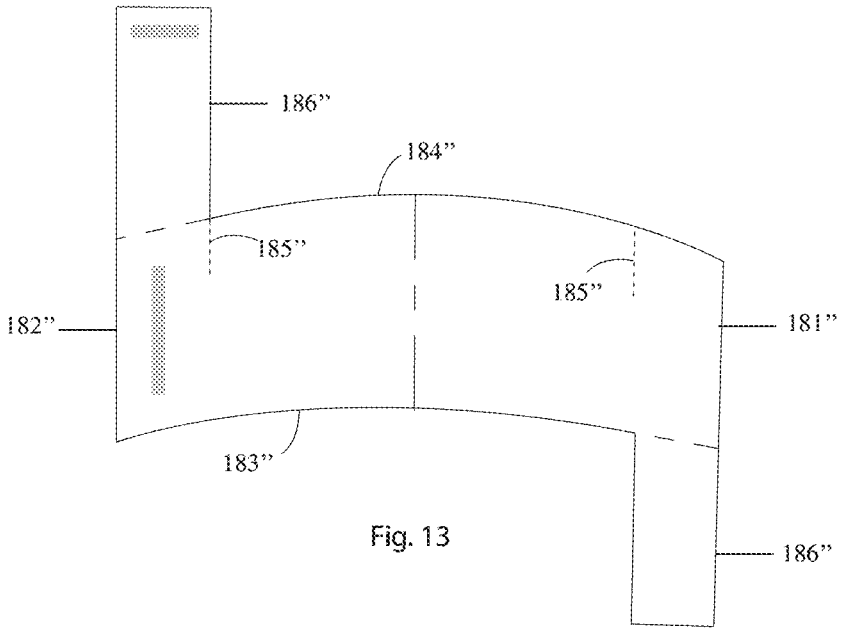
FIG. 13 is a plan view of a cup holder in the flat and prior to assembly into the cup holder, such as the cup holder shown in FIG. 5.

FIG. 13 shows another example of a flat work-piece that is configured to form a holder (e.g., the holder 101) when assembled. The illustrated flat work-piece has the same basic configuration as the work-piece shown in FIG. 11, except is missing the bottom left arm and the top right arm. Thus, the work-piece includes a first arm 186" extending above the top side 184" proximate the second side 182" of the base 180" and a second arm 186" extending below the bottom side 183" proximate the first side 181" of the base 180". The perforations 185" are configured the same (e.g., in the same location, having the same arrangement, etc.) as the perforation 185', and the work-piece is assembled in a manner that is similar to that described above for the work-piece shown in FIG. 11.

Figure 14:
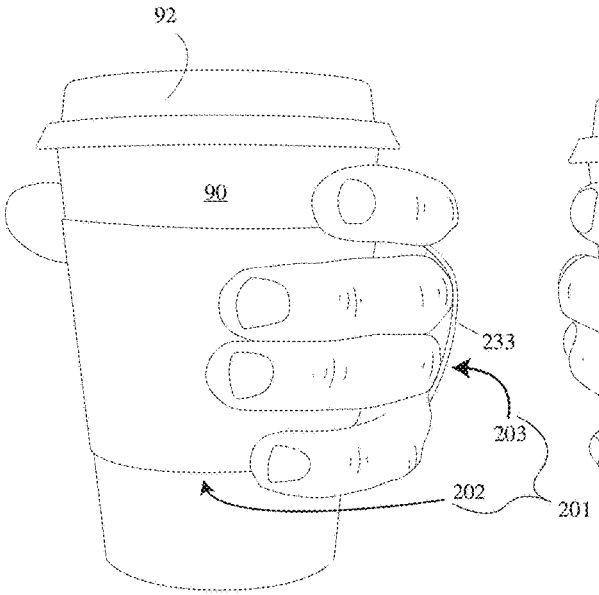
FIG. 14 is a front perspective view of another embodiment of a cup holder shown holding a cup and being grasped by a hand.
Figure 15:
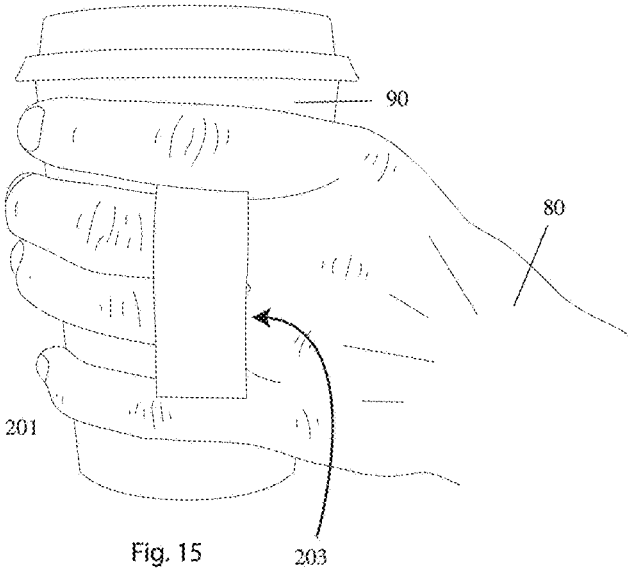
FIG. 15 is a side perspective view of the cup holder shown in FIG. 14.
Figure 16:
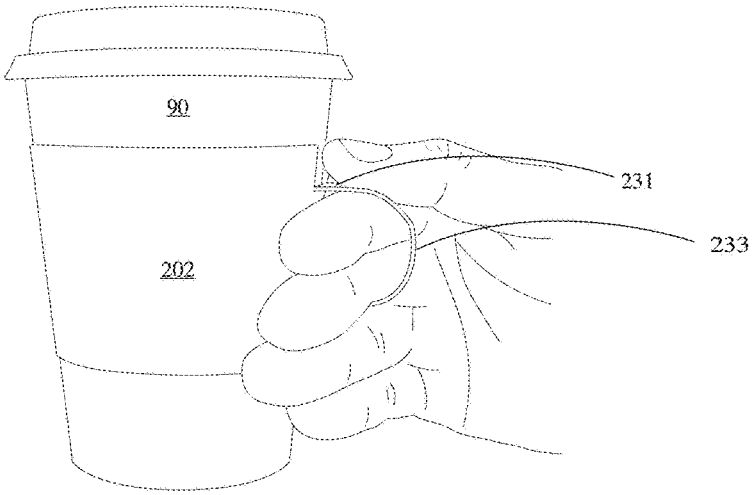
FIG. 16 is another perspective view of the cup holder shown in FIG. 14.
Figure 17:
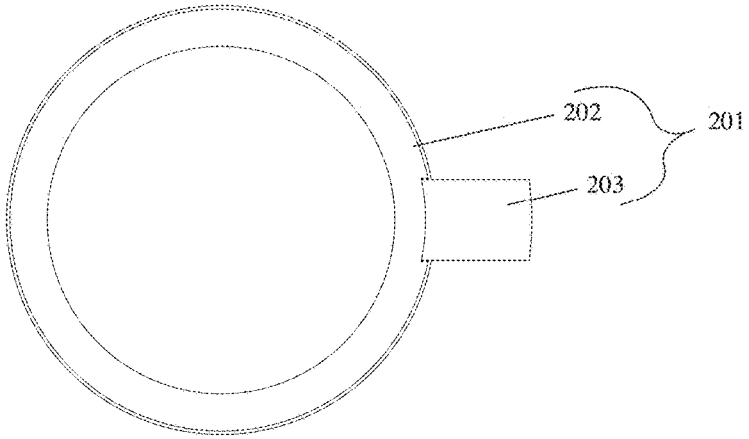
FIG. 17 is a top view of the cup holder shown in FIG. 16 without a cup.
Figure 18:
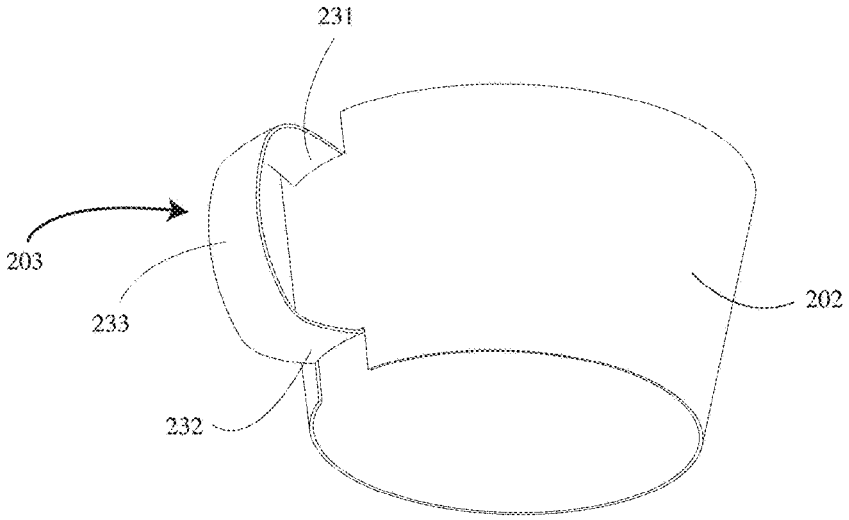
FIG. 18 is a perspective view of the cup holder shown in FIG. 17.
Figure 19:
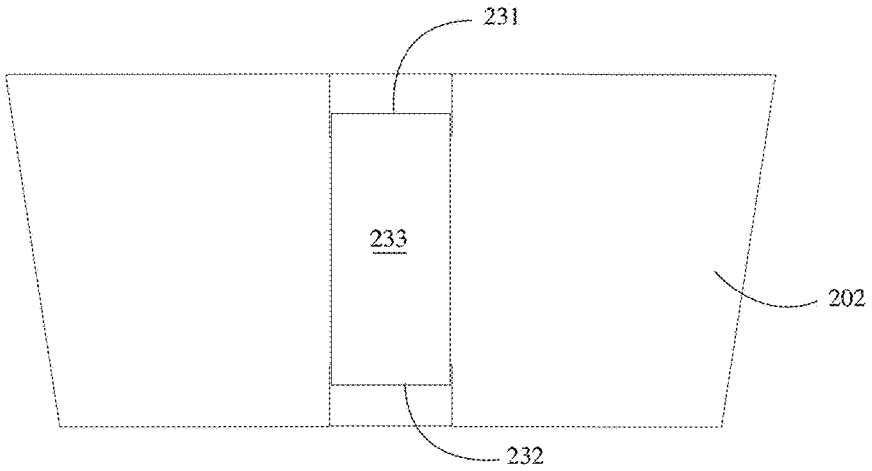
FIG. 19 is a plan view of the cup holder shown in FIG. 18.
Figure 27:
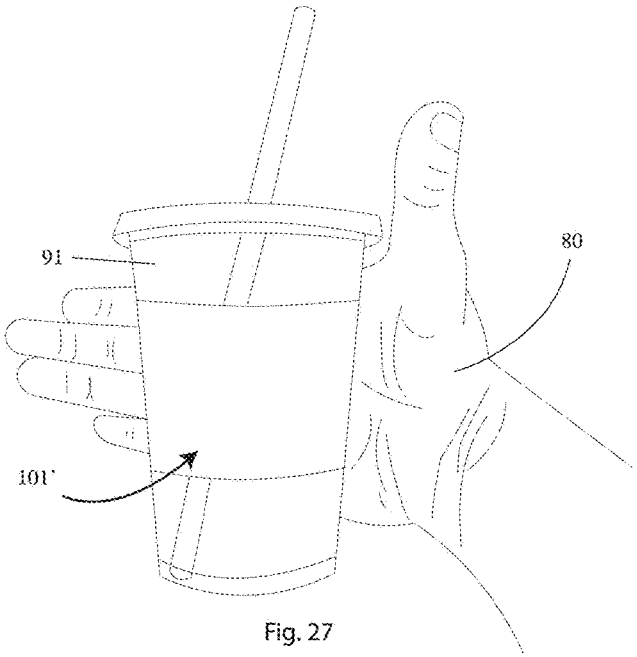
FIG. 27 is a perspective view of another cup holder.

FIGS. 14-19 illustrate an embodiment of a holder 201 for carrying a cup 90 for coffee, tea, and other hot/cold beverages as shown in FIGS. 14-16, although the holder 201 can hold other types of cups, containers, packages, and the like for any suitable beverage/liquid, such as cup 91 shown in FIG. 27. The illustrated holder 201 includes a sleeve 202, which is configured to receive the cup 90, 91, and a handle 203, which is configured to aid the person in carrying the holder 201 and the cup carried therein. For example, a person can extend one or more fingers through the handle 203 while wrapping the palm of the hand 80 around the sleeve 202, or a person does not have to hold the sleeve, such as by extending one's fingers through the handle 203 (i.e., between the handle and the sleeve) like one holds a mug. The configuration (e.g., size, shape, position relative to the sleeve, etc.) of the handle 203 is adjustable so that a person can tailor the configuration to one's preference (e.g., comfort, ease to carry, etc.).

The sleeve 202 can be configured the same as, similar to, or different than the sleeve 102. The handle 203 is the same as or similar to the handle 103, except where noted otherwise. For example, one difference is that a second end portion 232 (in addition to a first end portion 231) of the handle 203 is configured to provide adjustability through one or more perforations, such as to allow for the configuration (e.g., size, shape, etc.) to be changed by a user to accommodate the user's preference. The arrangement shown in FIGS. 14-19 advantageously is able to provide increased finger room, which allows the holder 201 to be held like a mug, such as, for example, by allowing an intermediate portion 233, which is provided between the first and second end portions 231, 232, to form a shape that is adjustable from a loop to triangular upon manipulation.

Figure 20:
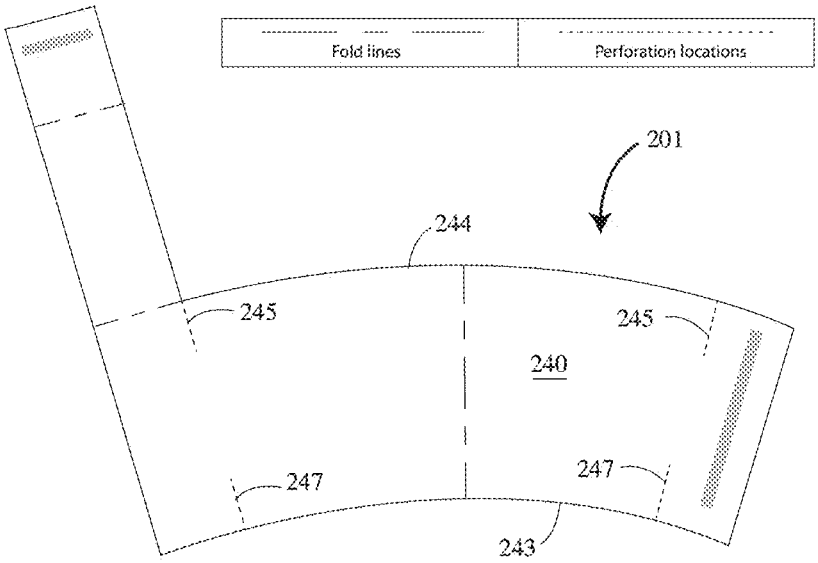
FIG. 20 is a plan view of a cup holder in the flat and prior to assembly into the cup holder shown in FIG. 18.

FIG. 20 illustrates the holder 201 as a flat work-piece, which is shown having the same basic shape as the holder 101 shown in the flat in FIG. 8, except the holder 201 includes two lower perforations 247 in addition to two upper perforations 245 in the base 240. Thus, each upper perforation 245 is the same as or similar to the associated perforation of the holder 101 shown in FIG. 8, and extends from a top side 244 of a base 240 toward a bottom side 243 by a first distance. Each lower perforation 247 extends from the bottom side 243 toward the top side 244 of the base 240 by a second distance. Each lower perforation 247 can be substantially collinear with the associated upper perforation 245, such as shown in FIG. 20, with an intermediate non-perforated section disposed between each pair of lower and upper perforations 247, 245. Thus, the upper perforations 245 can cooperate with the lower perforations 247 to provide adjustability of both the top and the bottom (or both the first and second ends 231, 232) of the handle 203 (e.g., the first end 231), as described above for the perforations shown in FIG. 8. Further, the flat work-piece shown in FIG. 20 can be assembled into the holder 201 using the same or similar process as that described above for the holder 101, with the further ability to provide adjustability to the second end 232 by tearing along the lower perforations 247.

Figure 21:
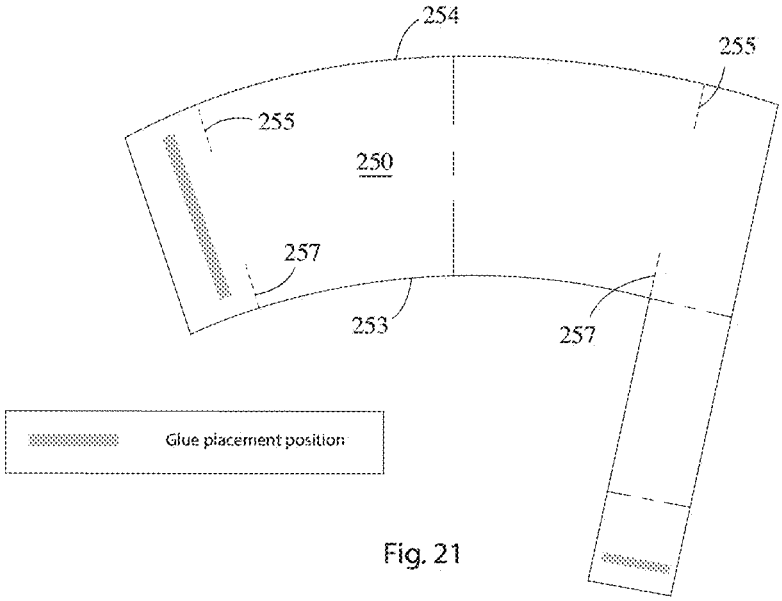
FIG. 21 is a plan view of a cup holder in the flat and prior to assembly into the cup holder, such as the cup holder shown in FIG. 18.

FIG. 21 illustrates the holder (e.g., the holder 201) as a flat work-piece, which is shown having the same basic shape as the holder shown in the flat in FIG. 9, except the holder shown in FIG. 21 includes two lower perforations 257 in addition to the two upper perforations 255, like the holder shown in FIG. 20. Thus, the upper perforations 255 extend downwardly from a top side 254 of a base 250 toward a bottom side 253 by a first distance, and the lower perforations 257 extend upwardly from the bottom side 253 toward the top side 254 by a second distance, with an intermediate non-perforated section disposed between each pair of lower and upper perforations. The perforations 255, 257 cooperate to provide adjustability of both the top and the bottom (e.g., both the first and second ends 231, 232) of the handle 203 (e.g., the first end 231). Further, the flat work-piece shown in FIG. 21 can be assembled into the holder 201 using the same or similar process as that described above.

Figure 22:
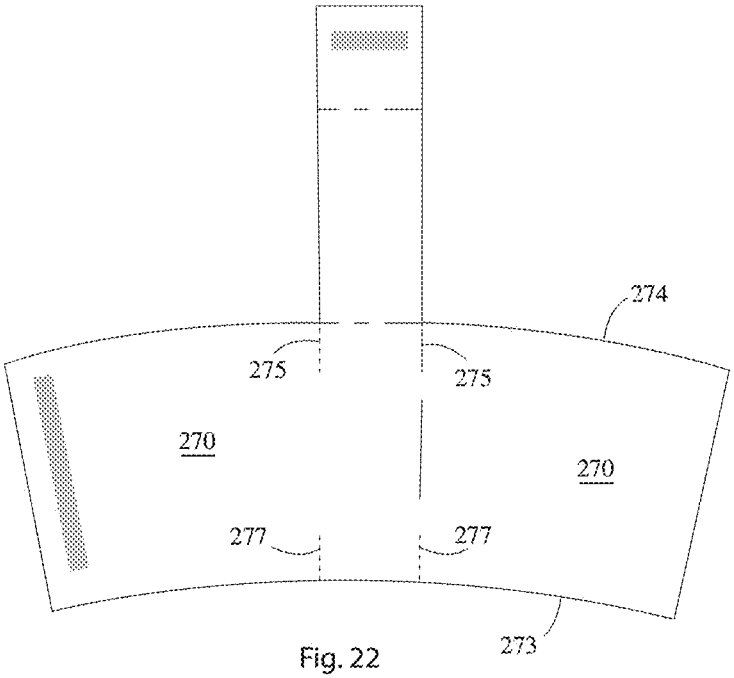
FIG. 22 is a plan view of a cup holder in the flat and prior to assembly into the cup holder, such as the cup holder shown in FIG. 18.

FIG. 22 illustrates the holder (e.g., the holder 201) as a flat work-piece, which is shown having the same basic shape as the holder shown in the flat in FIG. 10, except the holder shown in FIG. 22 includes two lower perforations 277 in addition to the two upper perforations 275. The upper perforations 275 are the same as or similar to the perforations 177, 178 shown in FIG. 10 and extend downwardly from a top side 274 of a base 270 toward a bottom side 273 by a first distance. The lower perforations 277 extend upwardly from the bottom side 273 toward the top side 274 by a second distance. An intermediate non-perforated section is disposed between each pair of lower and upper perforations 277, 275. The perforations 275, 277 provide adjustability of both the top and the bottom (e.g., both the first and second ends 231, 232) of the handle 203 (e.g., the first end 231). Further, the flat work-piece shown in FIG. 22 can be assembled into the holder 201 using a process described above.

Figure 23:
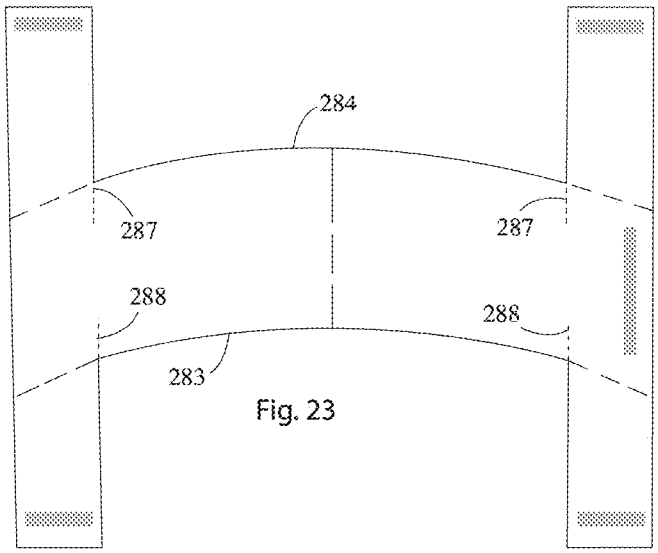
FIG. 23 is a plan view of a cup holder in the flat and prior to assembly into the cup holder, such as the cup holder shown in FIG. 18.

FIG. 23 illustrates the holder (e.g., the holder 201) as a flat work-piece, which is shown having the same basic shape as the holder shown in the flat in FIG. 11, except the holder shown in FIG. 23 includes two lower perforations 288 in addition to the two upper perforations 287. The upper perforations 287 are the same as or similar to the perforations 187 shown in FIG. 11 and extend downwardly from a top side 284 of a base toward a bottom side 283 by a first distance. The lower perforations 288 extend upwardly from the bottom side 283 toward the top side 284 by a second distance, with an intermediate non-perforated section disposed between each pair of lower and upper perforations 288, 287. The perforations 288, 287 provide adjustability of both the top and the bottom (e.g., both the first and second ends 231, 232) of the handle 203 (e.g., the first end 231). Further, the flat work-piece shown in FIG. 23 can be assembled into the holder 201 using a process described above.

Figure 24:
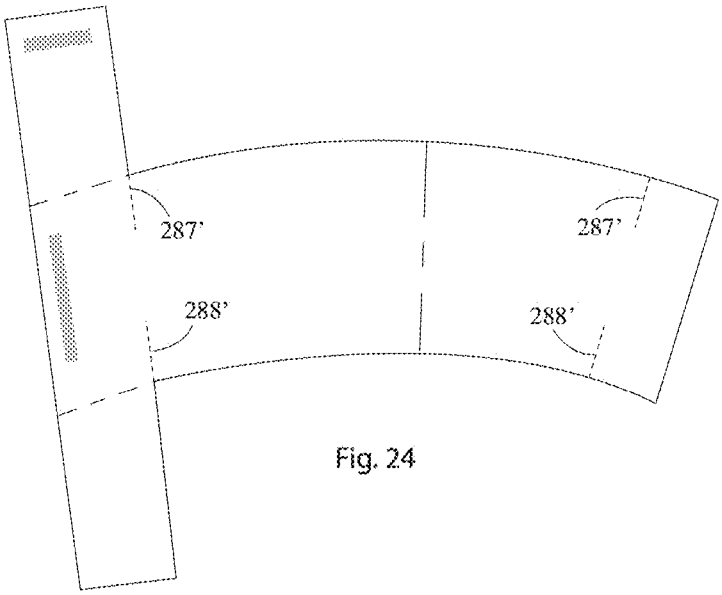
FIG. 24 is a plan view of a cup holder in the flat and prior to assembly into the cup holder, such as the cup holder shown in FIG. 18.

FIG. 24 illustrates the holder (e.g., the holder 201) as a flat work-piece, which is shown having the same basic shape as the holder shown in the flat in FIG. 12, except the holder shown in FIG. 24 includes two lower perforations 288' in addition to the two upper perforations 287'. The upper perforations 287' are the same as or similar to the upper perforations 287 shown in FIG. 23 and/or the upper perforations 185' shown in FIG. 12. The lower perforations 288' are the same as or similar to the upper perforations 288 shown in FIG. 23. Thus, the perforations 288', 287' provide adjustability of both the top and the bottom (e.g., both the first and second ends 231, 232) of the handle 203 (e.g., the first end 231). Further, the flat work-piece shown in FIG. 24 can be assembled into the holder 201 using a process described above.

Figure 25:
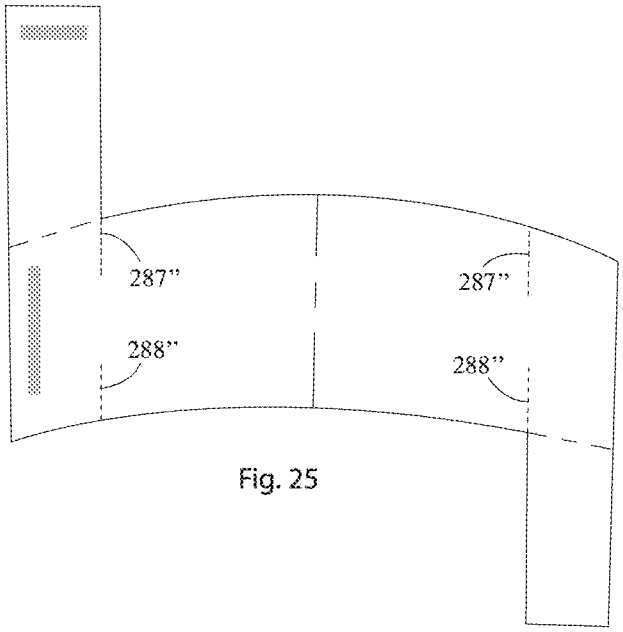
FIG. 25 is a plan view of a cup holder in the flat and prior to assembly into the cup holder, such as the cup holder shown in FIG. 18.

FIG. 25 illustrates the holder (e.g., the holder 201) as a flat work-piece, which is shown having the same basic shape as the holder shown in the flat in FIG. 13, except the holder shown in FIG. 25 includes two lower perforations 288" in addition to the two upper perforations 287". The upper perforations 287" are the same as or similar to the upper perforations 287 shown in FIG. 23 and/or the upper perforations 185" shown in FIG. 13. The lower perforations 288" are the same as or similar to the upper perforations 288 shown in FIG. 23. Thus, the perforations 288", 287" provide adjustability of both the top and the bottom (e.g., both the first and second ends 231, 232) of the handle 203 (e.g., the first end 231). Further, the flat work-piece shown in FIG. 25 can be assembled into the holder 201 using a process described above.

Figure 26:
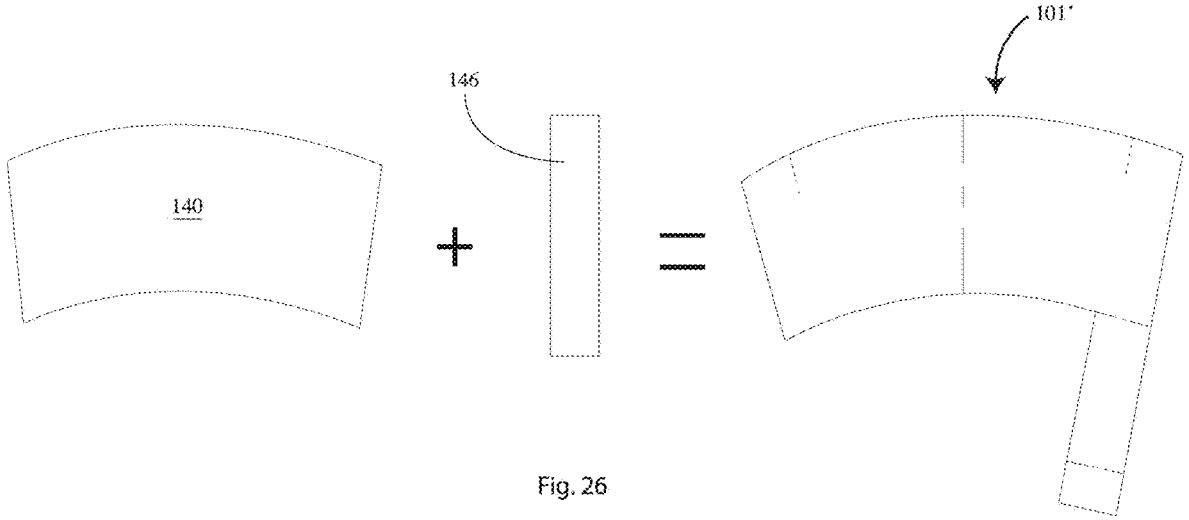
FIG. 26 is a plan view of a two-piece cup holder.

FIG. 26 illustrates that a holder 101', which is configured basically the same as the holder 101, except the holder 101' is configured using a two-piece arrangement, with the arm 146 and the base 140 being separate elements. That is, the arm 146 and the base 140 are formed separately and then coupled together to form the assembled holder 101'. The two-piece arrangement can be employed with any of the holders disclosed herein. For any two-piece arrangement, the arm and the base can be made from the same material or different materials. For example, the base or sleeve can be made from a material providing a relative higher thermal insulation or insulative performance (e.g., a relatively lower thermal conductivity), while the arm or handle can be made from a material providing higher strength and/or flexibility.

Figure 28:
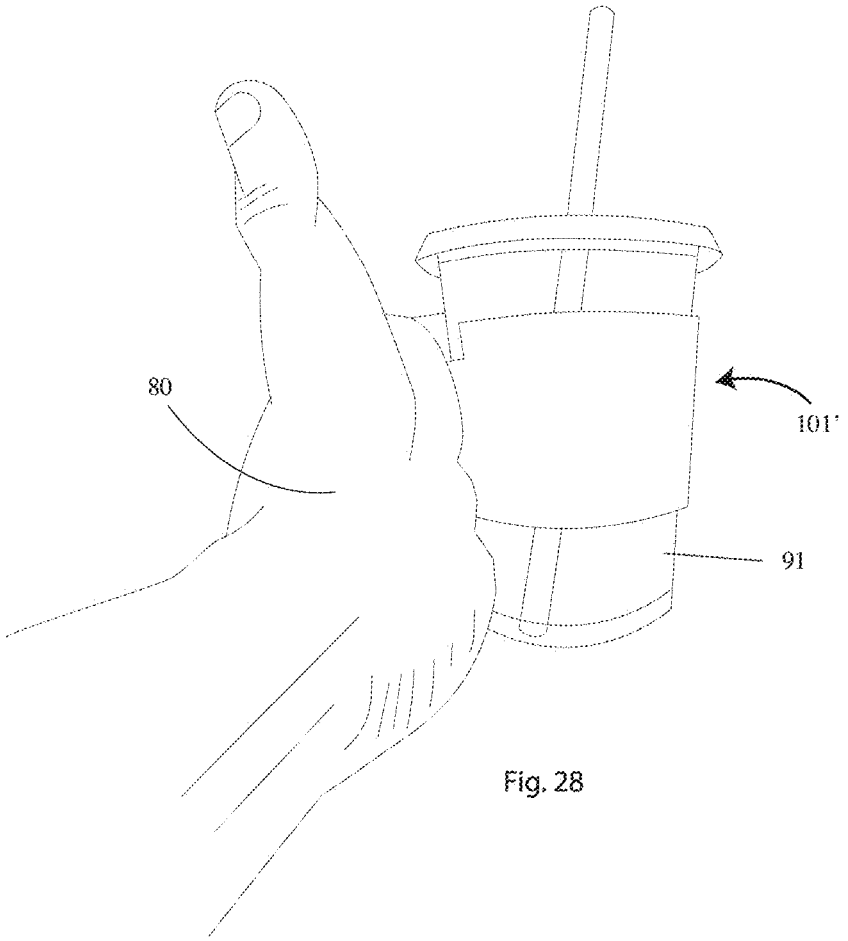
FIG. 28 is another perspective view of the cup holder shown in FIG. 27.
Figure 29:
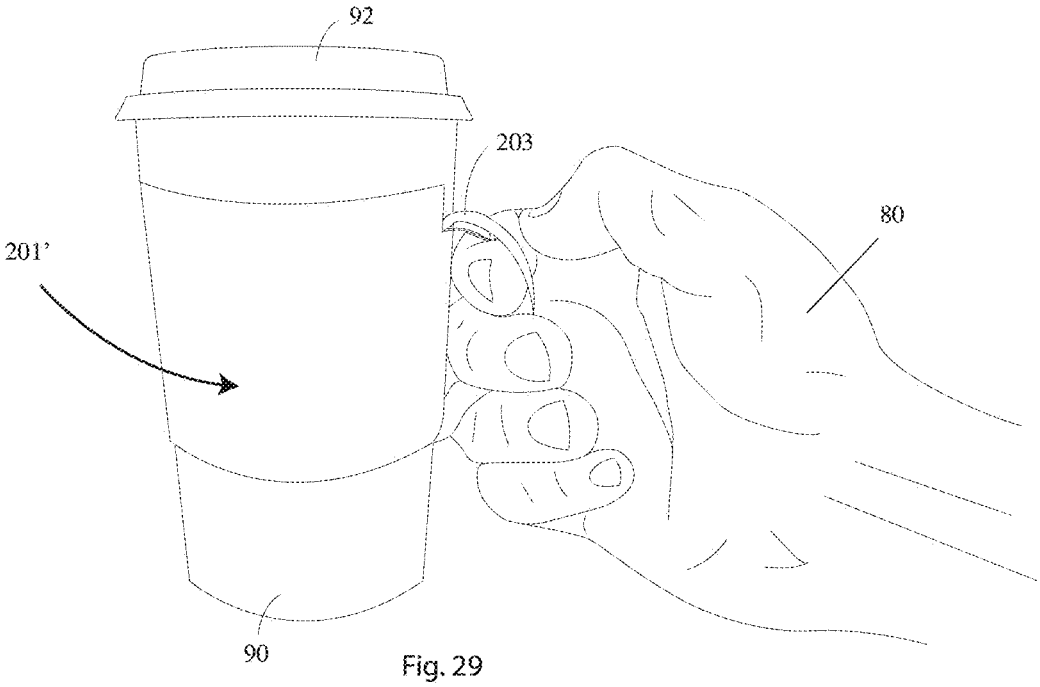
FIG. 29 is another perspective view of the cup holder shown in FIG. 27 with another cup.

FIGS. 27-29 illustrate holders 101', 201' that are configured to advantageously make it easier to carry different types of cups 90, 91 by having a handle that is adjustable by a user. FIGS. 27 and 28 illustrate the holder 101' holding another cup 91, such as for cold drinks, and being held by a hand 80 of a user, with one or more fingers of the user passing through a loop of the holder and with the palm wrapping around the sleeve. FIG. 29 illustrates a user holding the holder 201' like a mug, with two fingers passing through the loop of the holder 201'. The holder 201' is configurable as a two-piece holder, like the holder 101', or a one-piece holder. The handle 203' is adjustable to a fit a user preferred size, such as where the handle fits snugly. The adjustability allows different people having different sized hands, fingers, etc., to use the same holder with equal comfort and function. For example, a person can carry a cup (e.g., cup 90, 91) in the holder 201' just by the ends of the fingers extending through the loop formed by the handle as shown in FIG. 29 (like one would carry a mug). Also for example, a person can carry a cup in the holder 101' by having the base of the fingers extending through the loop formed by the handle as shown in FIGS. 27 and 28 with the palm resting against (but not necessarily cupping or wrapping around) the cup. In this way, a person does not even have to grip the cup and/or holder (e.g., sleeve) with their palm, because the adjustable handle provides extra stability over non-adjustable handles. Further, the adjustability can be limited to one end of the handle or utilized at both ends of the handle through one or more perforated elements, sections, portions, etc., which allow the configuration (e.g., size, shape, etc.) of the handle to be tailored.

Figure 30:
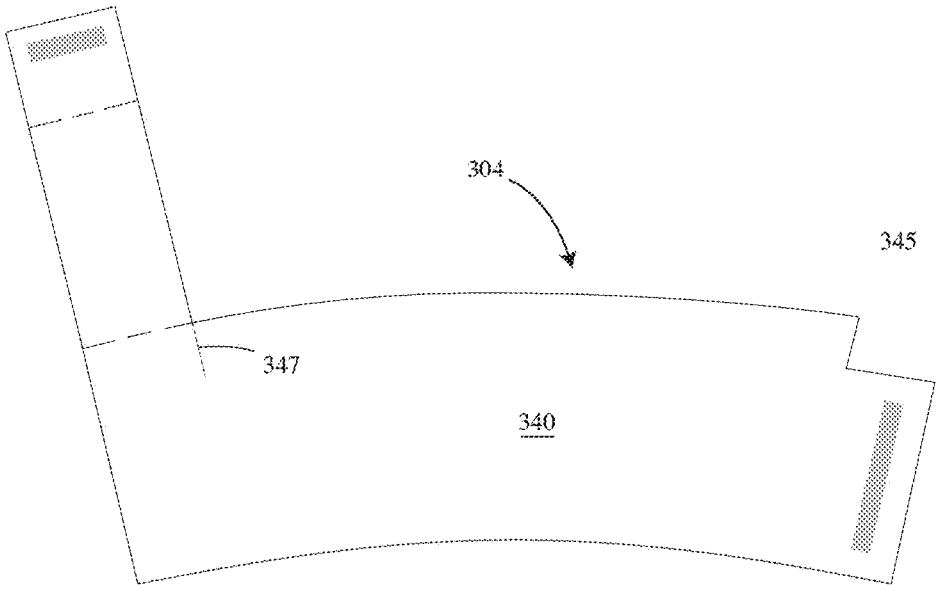
FIG. 30 is a plan view of a cup holder in the flat and prior to assembly into a cup holder.

FIG. 30 illustrates a holder as a flat work-piece 304, which is shown to be substantially the same as the holder 101 shown in the flat in FIG. 8, except the flat work-piece 304 includes a notch 345 in an upper right corner of the base 340 in place of the perforation 145 and corner of the base 140 shown in FIG. 8. The flat work-piece 304 has a perforation 347 that is the same as the perforation 147 of the holder 101. Further, the flat work-piece 304 shown in FIG. 30 can be assembled using the same or similar process as those described above.

Figure 31:
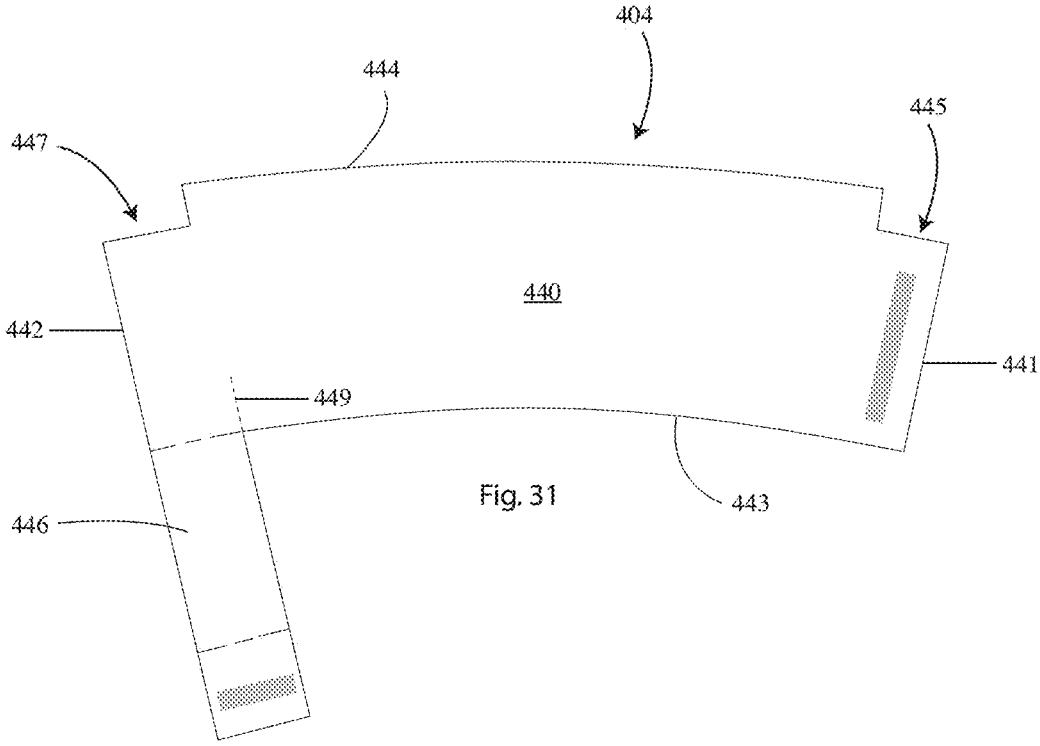
FIG. 31 is a plan view of a cup holder in the flat and prior to assembly into a cup holder.

FIG. 31 illustrates a holder as a flat work-piece 404, which is shown to be similar to the holder 101 shown in the flat in FIG. 8, except as noted. The work-piece 404 includes an arm 446 extending downwardly from a bottom side 443 of the base 440 (rather than a top side) and proximate to a second side 442, which is opposite a first side 441. The work-piece 404 also includes first and second notches 445, 447 provided in upper right and upper left corners of the base 440, respectively, in place of perforations. The work-piece 404 can include a perforated element 449 extending from the bottom side 443 toward a top side 444, and the perforation can extend collinear with an edge of the arm 446. Further, the flat work-piece 404 shown in FIG. 31 can be assembled using the same or similar process as those described above.

Figure 32:
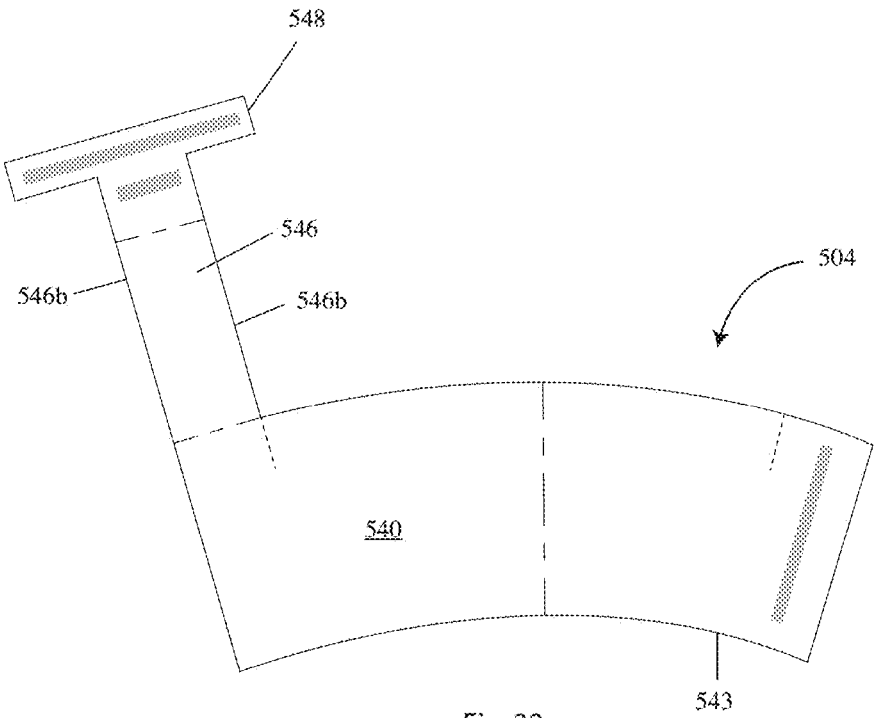
FIG. 32 is a plan view of a cup holder in the flat and prior to assembly into a cup holder.

FIG. 32 illustrates a holder 504 in the flat (e.g., as a flat work-piece) and prior to forming (e.g., assembly) into a cup holder. As shown, the flat holder 504 is configured basically the same as the holder 101 shown in the flat in FIG. 8, except the flat holder 504 includes a strip 548 at the end of an arm 546. The arm 546 has the same basic shape as the arm 146 of the holder 101. The strip 548 is located at the end of the arm 546, which is opposite the base 540. The illustrated strip 548 extends laterally from each side 546*b* of the arm 546, such that the strip 548 has a width that is larger than a width of the arm 546 (e.g., a distance between the two sides 546*b*). Adhesive can be applied to the strip 548 and/or the distal end of the arm to secure the strip 548 and/or the arm to a portion of the base 540 upon assembly. For example, the strip 548 can be wrapped around a bottom side 543 of the base 540 and secured to an inside bottom portion of the base 540 upon assembly. The increased width of the strip 548 provides a stronger base securing the arm 546 to the base 540 forming a stronger handle upon forming the holder.

Figure 33:
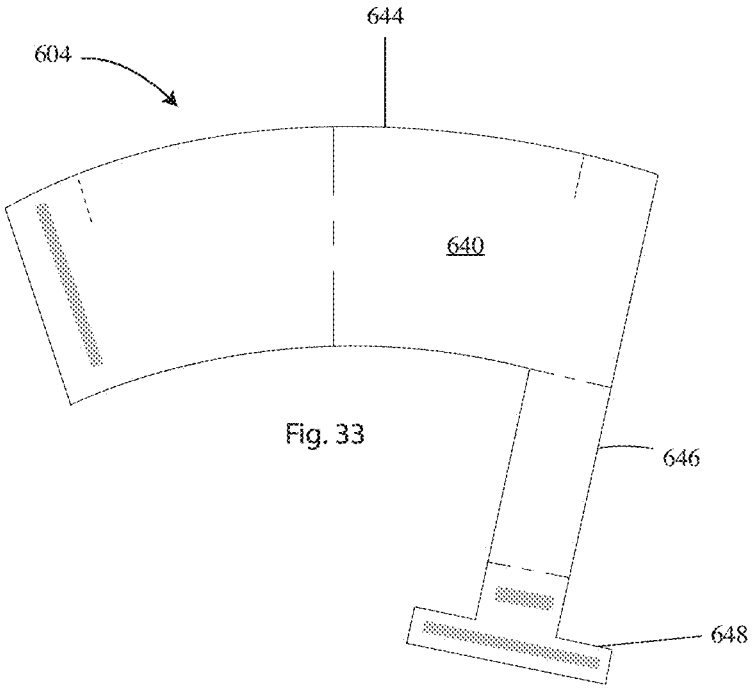
FIG. 33 is a plan view of a cup holder in the flat and prior to assembly into a cup holder.

FIG. 33 illustrates a holder 604 in the flat (e.g., as a flat work-piece) and prior to forming (e.g., assembly) into a cup holder. As shown, the flat holder 604 is configured basically the same as the holder shown in the flat in FIG. 9, except the holder 604 includes a strip 648 at the end of an arm 646. The arm 646 has the same basic shape as the arm 156. The strip 648 is disposed at the end of the arm 646, which is opposite the base 640. The illustrated strip 648 extends laterally from each side of the arm 646, such that the strip 648 has a width that is larger than a width of the arm 646. During assembly, adhesive can be applied to the strip 648 and/or the distal end of the arm to secure the strip 648 and/or the arm to a portion of the base 640. For example, the strip 648 can be wrapped around a top side 644 of the base 640 and secured to an inside top portion of the base 640 upon assembly. The increased width of the strip 648 provides a stronger base securing the arm 646 to the base 640 forming a stronger handle upon forming the holder.

Figure 34:
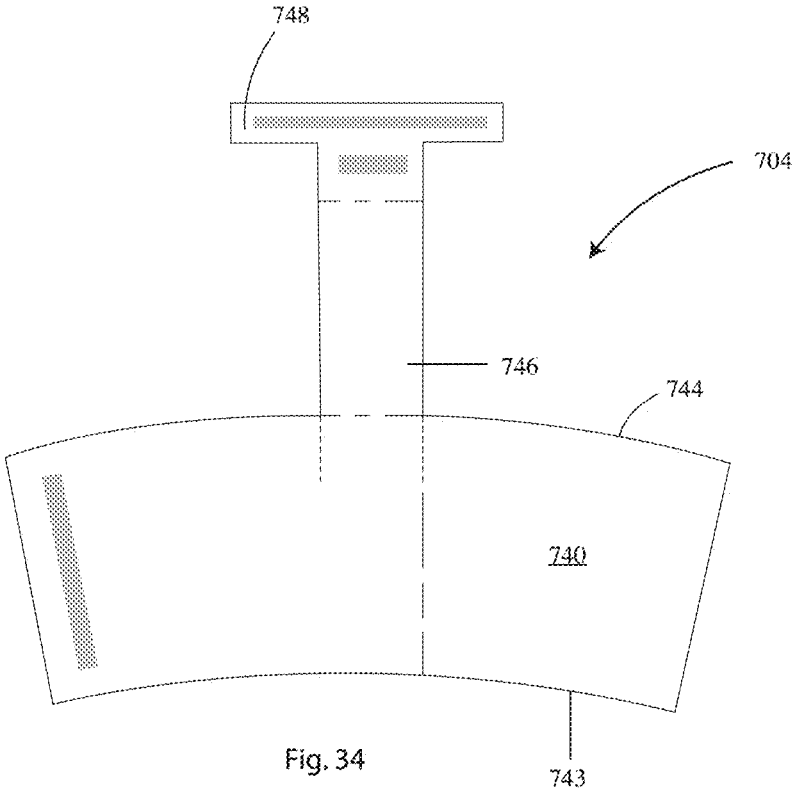
FIG. 34 is a plan view of a cup holder in the flat and prior to assembly into a cup holder.

FIG. 34 illustrates a holder 704 in the flat (e.g., as a flat work-piece) and prior to forming (e.g., assembly) into a cup holder. As shown, the flat holder 704 is configured basically the same as the holder shown in the flat in FIG. 10, except the flat holder 704 includes a strip 748 at the end of an arm 746. The arm 746 has the same basic shape as the arm 176 of the holder shown in FIG. 10, as the arm 746 extends upwardly from a central portion of a top side 744 of the base 740. The strip 748 is disposed at the distal end of the arm 746. The illustrated strip 748 extends laterally from each side of the arm 746 forming a T-shape with the arm 746, such that the strip 748 has a width that is larger than a width of the arm 746. Adhesive can be applied to the strip 748 and/or the distal end of the arm to secure the strip 748 and/or the arm to a portion (e.g., a bottom central portion) of the base 740 upon assembly.

Figure 35:
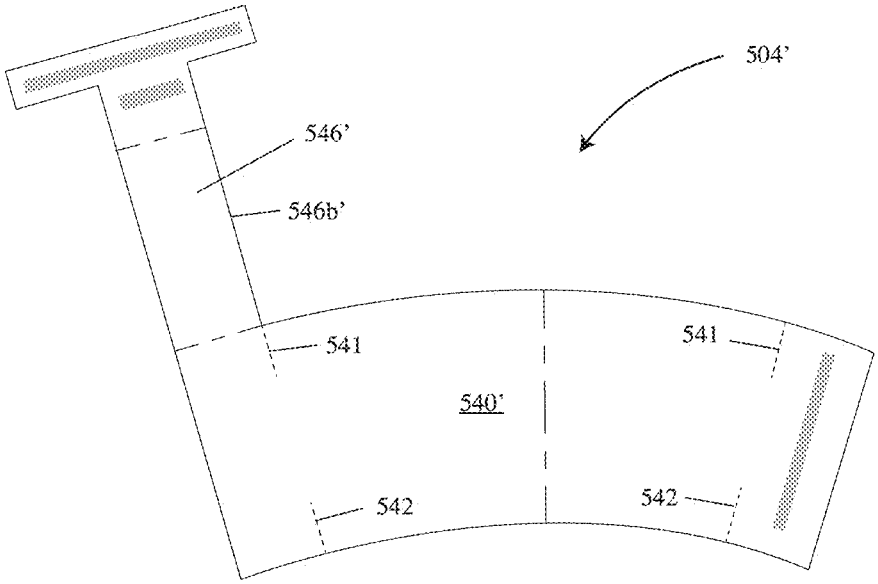
FIG. 35 is a plan view of a cup holder in the flat and prior to assembly into a cup holder.

FIG. 35 illustrates another holder 504' in the flat (e.g., as a flat work-piece) and prior to forming (e.g., assembly) into a cup holder. As shown, the flat holder 504' is configured basically the same as the holder 504 shown in the flat in FIG. 32, except the flat holder 504' includes both top and bottom perforated elements 541, 542 in the base 540', as opposed to only top perforated elements like the holder 504. The illustrated holder 504' includes two top perforated elements 541 and two bottom perforated elements 542. Each bottom perforated element 542 is aligned (e.g., collinear) with one top perforated element 541, but is separated from the top perforated element 541 by a non-perforated section of the base 540'. The left pair of the elements 541, 542 are shown aligned with an inner edge 546*b*' of the arm 546', and the right pair of the elements 541, 542 are offset inwardly from a right side of the base 540' by a distance, which may be the same as the width of the arm 546'. Thus, each end of the handle of the holder 504' is adjustable via the perforated elements 541, 542, as opposed to just one end (shown as the top end) of the handle 504 is adjustable via the perforated elements.

Figure 36:
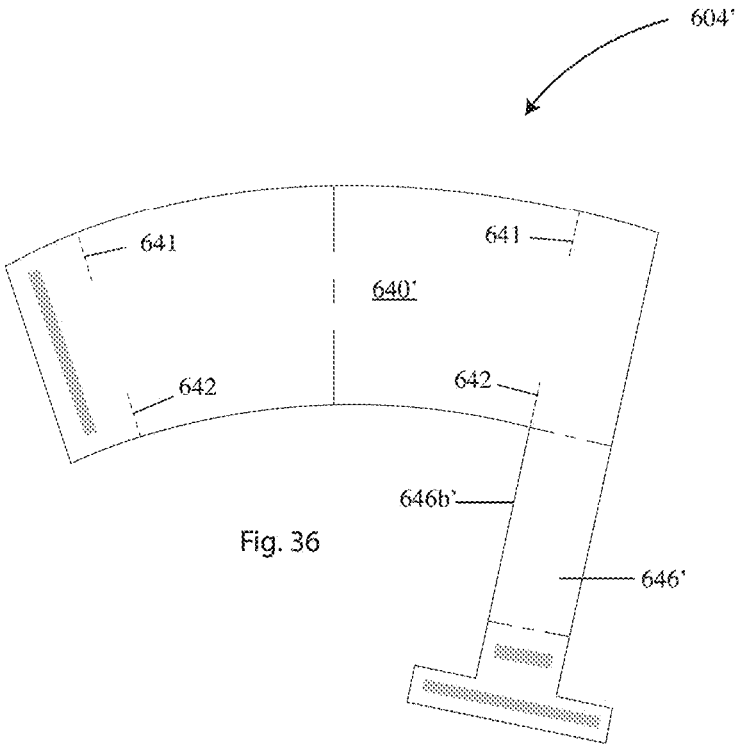
FIG. 36 is a plan view of a cup holder in the flat and prior to assembly into a cup holder.

FIG. 36 illustrates another holder 604' in the flat (e.g., as a flat work-piece) and prior to forming (e.g., assembly) into a cup holder. As shown, the flat holder 604' is configured basically the same as the holder 604 shown in the flat in FIG. 33, except the flat holder 604' includes both top and bottom perforated elements 641, 642 in the base 640', as opposed to only top perforated elements like the holder 604. The illustrated holder 604' includes two top perforated elements 641 and two bottom perforated elements 642. Each bottom perforated element 642 is aligned (e.g., collinear) with one associated top perforated element 641, but is separated from the top perforated element 641 by a non-perforated section of the base 640'. The right pair of the elements 641, 642 are shown aligned with an inner edge 646*b*' of the arm 646', and the left pair of the elements 641, 642 are offset inwardly from a right side of the base 640' by a distance, which may be the same as the width of the arm 646'. Thus, each end of the handle of the holder 604' is adjustable via the perforated elements 641, 642, as opposed to just one end (shown as the top end) of the handle 604 is adjustable via the perforated elements.

Figure 37:
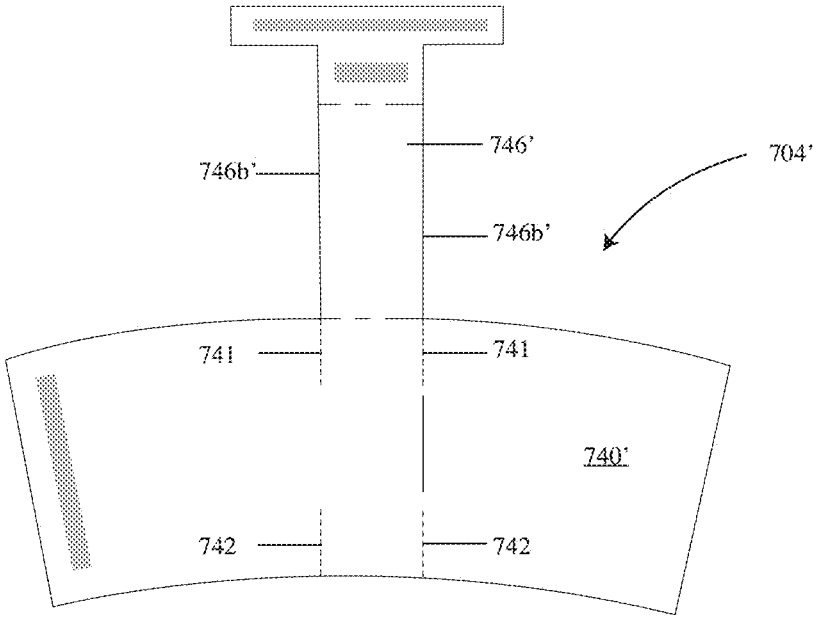
FIG. 37 is a plan view of a cup holder in the flat and prior to assembly into a cup holder.

FIG. 37 illustrates another holder 704' in the flat (e.g., as a flat work-piece) and prior to forming (e.g., assembly) into a cup holder. As shown, the flat holder 704' is configured basically the same as the holder 704 shown in the flat in FIG. 34, except the flat holder 704' includes both top and bottom perforated elements 741, 742 in the base 740', as opposed to only top perforated elements like the holder 704. The illustrated holder 704' includes two top perforated elements 741 and two bottom perforated elements 742. Each bottom perforated element 742 is aligned (e.g., collinear) with one associated top perforated element 741, but is separated from the associated top perforated element 741 by a non-perforated section of the base 740'. The right pair of the elements 741, 742 are shown aligned with a right side 746*b*' of the arm 746', and the left pair of the elements 741, 742 are shown aligned with a left side 746*b*' of the arm 746'. Thus, each end of the handle of the holder 704' is adjustable via the perforated elements 741, 742, as opposed to just one end (shown as the top end) of the handle 704 is adjustable via the perforated elements.

Figure 38:
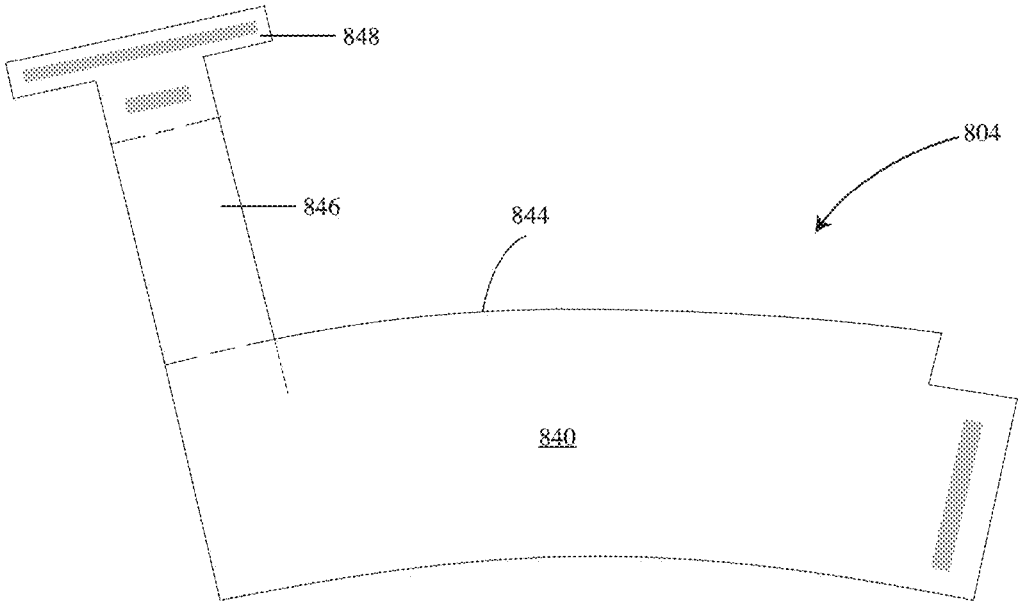
FIG. 38 is a plan view of a cup holder in the flat and prior to assembly into a cup holder.

FIG. 38 illustrates another holder 804 in the flat (e.g., as a flat work-piece) and prior to forming (e.g., assembly) into a cup holder. As shown, the flat holder 804 is configured basically the same as the holder 304 shown in the flat in FIG. 30, except the flat holder 804 includes a strip 848 at the end of an arm 846. The arm 846 extends from a left side of a top side 844 of the base 840, and the strip 848 is located at the distal end of the arm 846, which is opposite the base 840. The illustrated strip 848 extends laterally from each side of the arm 846 forming a T-shape with the arm, such that the strip 848 has a width that is larger than a width of the arm 846. Adhesive can be applied to the strip 848 and/or the distal end of the arm 846 to secure the strip 848 and/or the arm 846 to the base 840 upon assembly. For example, the strip 848 can be wrapped around a bottom side of the base 840 and secured to an inside bottom portion of the base 840, with the adhesive on the distal end of the arm 846 securing the distal end to an outside bottom portion of the base 840. Alternatively, both the strip 848 and the distal end of the arm can be secured to an outside bottom portion of the base 840 through the adhesive.

Figure 39:
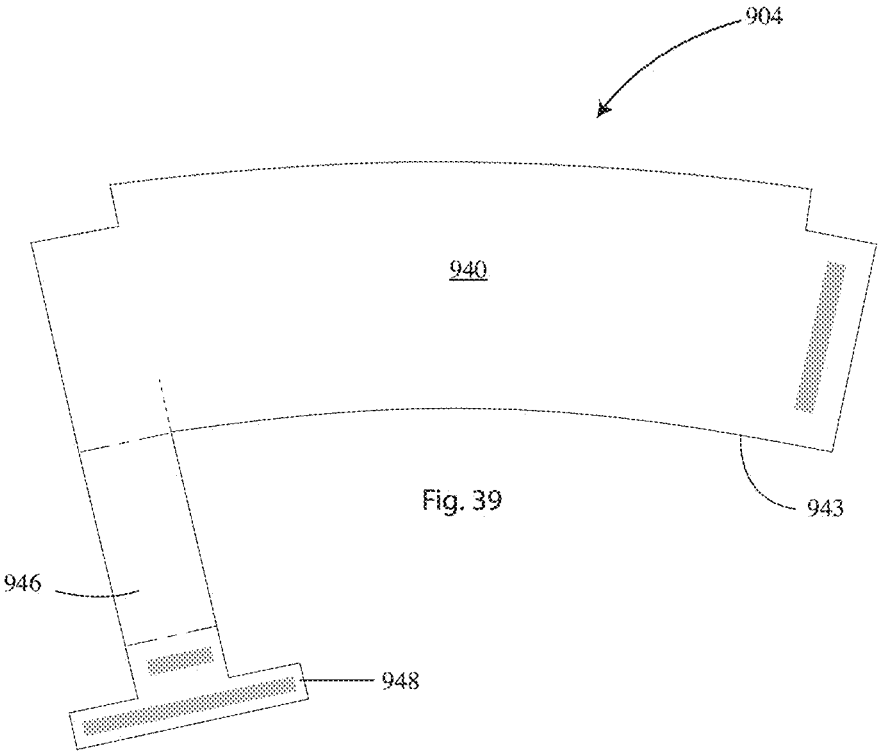
FIG. 39 is a plan view of a cup holder in the flat and prior to assembly into a cup holder.

FIG. 39 illustrates another holder 904 in the flat (e.g., as a flat work-piece) and prior to forming (e.g., assembly) into a cup holder. As shown, the flat holder 904 is configured basically the same as the holder 404 shown in the flat in FIG. 31, except the flat holder 904 includes a strip 948 at the end of an arm 946. The arm 946 extends from a left side of a bottom side 943 of the base 940, and the strip 948 is located at the distal end of the arm 946 opposite the base 940. The illustrated strip 948 extends laterally from each side of the arm 946 forming a T-shape with the arm 946, such that the strip 948 has a width that is larger than a width of the arm 946. Adhesive can be applied to the strip 948 and/or the distal end of the arm 946 to secure the strip 948 and/or the arm 946 to the base 940 upon assembly. For example, the strip 948 can be wrapped around a bottom side of the base 940 and secured to an inside bottom portion of the base 940, with the adhesive on the distal end of the arm 946 securing the distal end to an outside bottom portion of the base 940. Alternatively, both the strip 948 and the distal end of the arm can be secured to an outside bottom portion of the base 940 through the adhesive.

Figure 40:
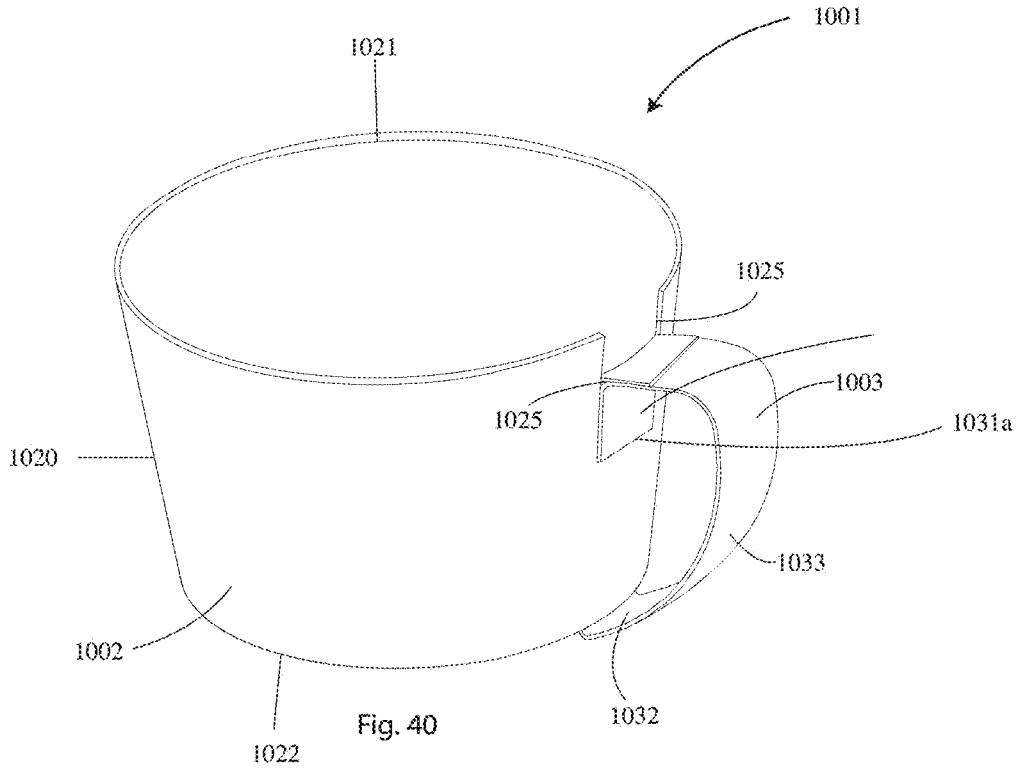
FIG. 40 is a perspective view of another cup holder.
Figure 41:
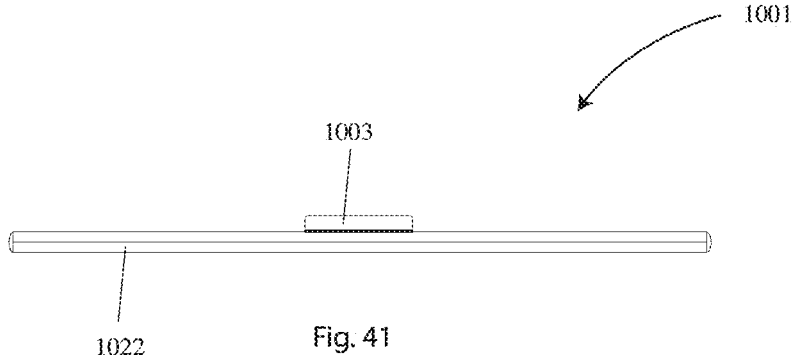
FIG. 41 is a top view of the cup holder shown in FIG. 39 in the flat.

FIGS. 40 and 41 illustrate another holder 1001 for carrying a cup, such as for hot or cold beverages. The holder 1001 includes a sleeve 1002, which receives and holds the cup, and a handle 1003, which a user can grasp with one or more fingers. The holder 1001 can be stored in a flat configuration, as shown in FIG. 41, and then expanded into an open configuration having a hollow frusto-conical shape, as shown in FIG. 40, to receive a cup. The illustrated sleeve 1002 tapers inwardly (e.g., narrows) moving from a top 1021 toward a bottom 1022 of a base 1020 of the sleeve 1002. Notably, the overall size (e.g., height, width, diameter(s), thickness, etc.) of the sleeve 1002 can vary from the sizes shown in FIGS. 40 and 41.

The handle 1003 couples to the sleeve 1002 to form a closed loop, which can receive one or more fingers of a person to facilitate carrying the holder 1001. As shown, the handle 1003 includes a first end portion 1031, a second end portion 1032, and an intermediate portion 1033 extending between and interconnecting the first and second end portions 1031, 1032. At least a portion of the first end portion 1031, which is shown as the upper end, overlaps with an outside (e.g., outwardly facing) portion of the sleeve 1002, which is located between two parallel perforated elements 1025 of the sleeve 1002. Thus, the overlapping areas form multi-layer portions of the holder 1001. The first end portion 1031 can initially extend up to or extend from the top 1021 of the sleeve 1002. However, the perforated elements 1025 allow the section of the sleeve 1002 that is located between the perforated elements 1025 to separate from the adjacent portions of the sleeve (e.g., the portions outside of the perforated elements 1025, as shown in FIG. 40, to adjust the handle 1003. The length of separation is adjustable and is a function of the length of the perforated elements 1025. The length of each perforated element 1025 can extend from the top 1021 up to the edge 1031*a* of the first end portion 1031, short of the edge 1031*a*, or beyond the edge 1031*a*. A user, thus, can adjust the configuration and position of the handle 1003 relative to the sleeve 1002 through adjusting (e.g., tearing) the perforated elements 1025. For example, the top of the handle can be adjusted relative to the top 1021 of the sleeve 1002, which can in-turn adjust the configuration (e.g., position) of the intermediate portion 1033 relative to the sleeve 1002. The second end portion 1032 of the handle 1003 can be fixed in place relative to the sleeve 1002, such as where no perforated elements are associated with the second end portion 1032. Alternatively, the second end portion 1032 can be adjustably coupled to the sleeve 1002, such as through one or more perforated elements. Thus, the handle 1003 is adjustable relative to the sleeve 1002 through the one or more perforated elements to allow a user to change the configuration (e.g., size, shape, etc.) of the loop defined by the handle 1003 and the sleeve 1002. This arrangement advantageously provides, among other things, improved stability while supporting the weight of the cup, so that it is easier for a person to carry the holder and cup when on the move.

Figure 42:
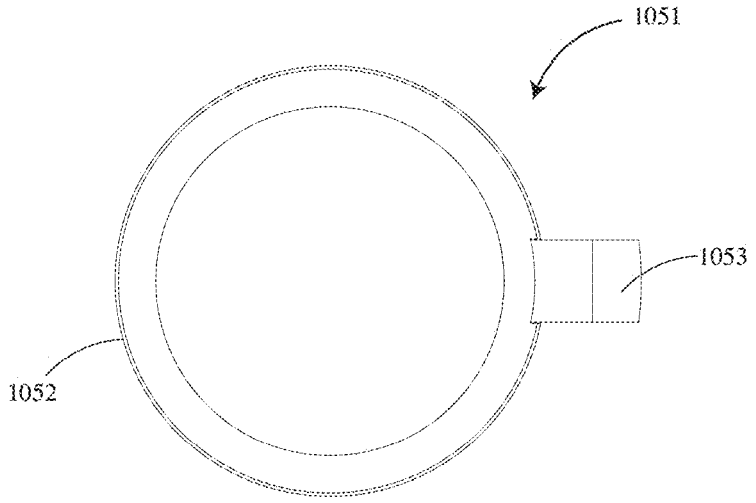
FIG. 42 is a top view of the cup holder shown in FIG. 39.
Figure 43:
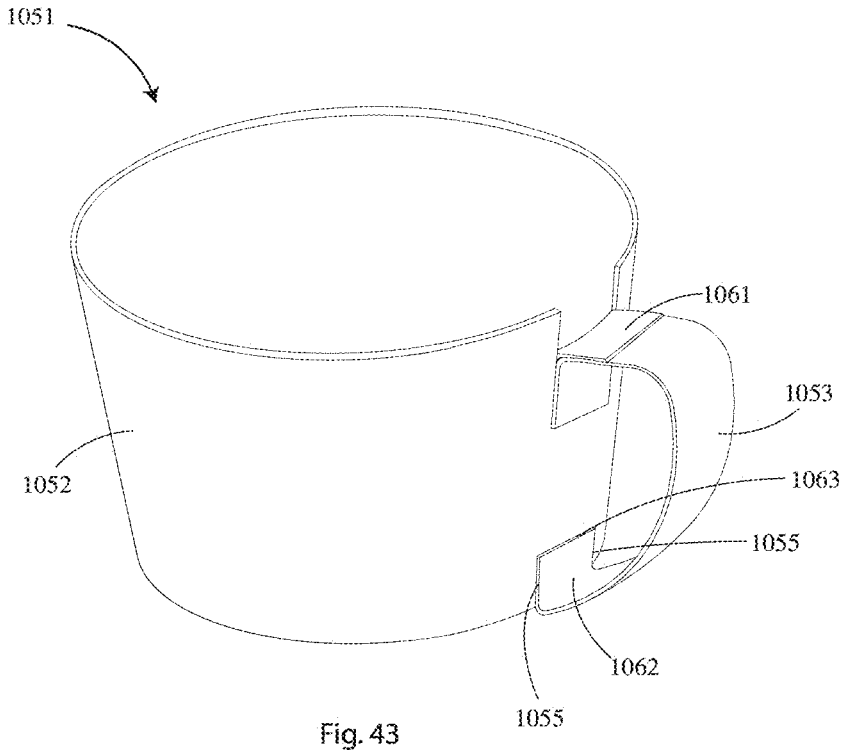
FIG. 43 is a perspective view of another cup holder.

FIGS. 42 and 43 illustrate another holder 1051 configured to receive and support a cup. The holder 1051 includes a sleeve 1052, which receives and holds the cup, and a handle 1053, which a user can grasp with one or more fingers. The holder 1051 can be stored in a flat configuration (not shown) and then expanded into an open configuration having a hollow frusto-conical shape, as shown, to receive a cup. The illustrated holder 1051 is configured basically the same as the holder 1001 shown in FIG. 40, except the holder 1051 includes an adjustable second end portion 1062 (in addition to an adjustable first end portion 1061) of the handle 1053 through perforated elements 1055 located where the second end portion 1062 couples to the sleeve 1052. Thus, the holder 1051 includes the perforated elements 1055 in addition to the perforated elements associate with the first end portion 1061 (e.g., the elements 1025 discussed above). As shown, the second end portion 1061 partially folds such that the second end portion 1062 couples to an outside (e.g., outwardly facing) bottom portion of the sleeve 1052. The length of each perforated element 1055 can extend from the bottom of the sleeve 1052 up to the edge 1063 of the second end portion 1062, short of the edge 1063, or beyond the edge 1063. Thus, the bottom of the handle 1053 is adjustable relative to the sleeve 1052 through the perforated elements 1055 to allow a user to change the configuration (e.g., size, shape, etc.) of the loop. As shown, a non-perforated element/section is provided between each pair of top and bottom perforated elements (e.g., elements 1025 and 1055, respectively), where the non-perforated element/section advantageously is a stronger section that prevents propagation of tear through the entire height of the sleeve.

With respect to the examples discussed herein, at least one embodiment of a cup holder includes a sleeve and a handle. The sleeve can expand from a flat position to an open position, in which the sleeve is configured to receive a cup. The handle can have first and second ends coupled to the sleeve at first and second locations to form a loop. A perforated element associated with one end of the first and second ends of the handle can provide for adjustability of the loop relative to the sleeve. The perforated element can include a first perforation, which extends inwardly from an edge of the sleeve proximate the one end of the first and second ends of the handle, and/or a second perforation extending inwardly from the edge of the sleeve. The handle can have first and second sides that extend between the first and second ends, with the first perforation in the sleeve aligned with the first side of the handle. The first side of the handle can align with a first side of the sleeve in a flat work-piece, such as where the second perforation is located between a second side of the sleeve and the second side of the handle. Each perforation can include a plurality of spaced apart notches or holes.

The cup holder can include additional perforated elements, such as a second perforated element that includes a first perforation in the sleeve, which extends inwardly from a second edge of the sleeve, and a second perforation in the sleeve, which extends inwardly from the second edge of the sleeve. The first edge of the sleeve can be one of a top and a bottom of the sleeve, and the second edge can be the other of the top and the bottom of the sleeve. The first perforation of the second perforated element can align with a first side of the second end of the handle, and the second perforation of the second perforated element can align with a second side of the second end of the handle.

The cup holder can include non-perforated sections as well, such as a first non-perforated section disposed between the first perforation of the first perforated element and the first perforation of the second perforated element, and/or a second non-perforated section disposed between the second perforation of the first perforated element and the second perforation of the second perforated element.

At least one of the first or second ends of the handle can include a strip, which extends laterally from at least one of a first side or a second side of the handle, such that the strip has a width that is larger than a width of the handle. The strip can couple the handle to the sleeve.

With respect to the examples discussed herein, at least one embodiment of a cup holder includes a sleeve and a handle. The sleeve can expand from a flat position to an open position, in which the sleeve is configured to receive a cup. The handle can include a first end coupled to a first portion of the sleeve, a second end coupled to a second portion of the sleeve, and an intermediate section extending between the first and second ends. The first portion can be positioned adjacent to a first edge of the sleeve, and the second portion can be positioned adjacent to a second edge of the sleeve. At least one of the first portion or the second portion can be defined by a first perforation, which extends inwardly from the associated edge of the sleeve at a first location, and/or a second perforation, which extends inwardly from the associated edge of the sleeve at a second location. For example, the first portion can be defined by the first and second perforations that extend inwardly from the first edge of the sleeve. Also for example, the second portion can be defined by a third perforation, which extends inwardly from the second edge of the sleeve at a first location, and a fourth perforation, which extends inwardly from the second edge of the sleeve at a second location. The cup holder can include non-perforated sections. For example, a first non-perforated section can extend between the first perforation and the third perforation. Also for example, a second non-perforated section can extend between the second perforation and the fourth perforation. The first perforation can be parallel to the second perforation, and/or the third perforation can be parallel to the fourth perforation.

With respect to the examples discussed herein, at least one embodiment of a cup holder includes a sleeve and a handle. The sleeve can expand from a flat position to an open position, in which the sleeve is configured to receive a cup. The handle can have first and second ends coupled to first and second portions of the sleeve, respectively, to form a loop. The first portion can be located adjacent to a first edge of the sleeve and is defined by a first perforated element, and/or the second portion can be located adjacent to a second edge of the sleeve and is defined by a second perforated element. Each of the first and second perforated elements can be adjustably separable from a base of the sleeve to adjust the loop relative to the base of the sleeve. Each of the first and second perforated elements can include a plurality of perforations that define edges of the associated portion of the first and second portions of the sleeve.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the holders, sleeves, handles, etc., as shown in the various exemplary embodiments, are illustrative only. Additionally, any element disclosed in one embodiment may be incorporated or utilized with any other embodiment disclosed herein. For example, the handle of the exemplary embodiment described in any one paragraph may be incorporated in any other exemplary embodiment described in any other paragraph. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A cup holder, comprising:

a sleeve that is expandable from a flat position to an open position and configured to receive a cup, the sleeve comprising an upper edge and a lower edge;

a handle having first and second ends coupled to the sleeve proximate the upper edge and lower edge to form a loop; and a first perforated element positioned proximate the upper edge and extending inwardly from the upper edge.

2. The cup holder of claim 1, wherein the first perforated element comprises a first perforation and a second perforation.

3. The cup holder of claim 2, wherein the first perforation extends along a line which is substantially parallel to a first side of the handle, and the second perforation extends along a line which is substantially parallel to a second side of the handle.

4. The cup holder of claim 2, wherein the handle comprises a first side and a second side extending between the first and second ends, and wherein the first perforation in the sleeve extends along a line which is substantially parallel to the first side of the handle.

5. The cup holder of claim 1, further comprising a second perforated element positioned proximate the lower edge and extending inwardly from the lower edge.

6. The cup holder of claim 5, wherein the perforated element is tearable to adjust a configuration of the handle relative to the sleeve.

7. The cup holder of claim 1, wherein the first perforated element comprises a first perforation and a second perforation, and wherein the cup holder further comprises:

a second perforated element extending inwardly from the lower edge, the second perforated element comprising a third perforation and a fourth perforation.

8. The cup holder of claim 7, wherein the first perforation and the third perforation extend along a common plane, and the second perforation and the fourth perforation extend along a common plane.

9. The cup holder of claim 8, further comprising:

a first non-perforated section disposed between the first perforation and the third perforation; and a second non-perforated section disposed between the second perforation and the fourth perforation.

10. The cup holder of claim 1, wherein at least one of the first or second ends of the handle includes a strip extending laterally from at least one of a first side or a second side of the handle, such that the strip has a width that is larger than a width of the handle, and wherein the strip couples to the sleeve.

11. A cup holder, comprising:

a sleeve that is expandable from a flat position to an open position and configured to receive a cup, the sleeve comprising an upper edge and a lower edge;

a handle having first and second ends coupled to the sleeve proximate the upper edge and lower edge to form a loop; and a first perforated element positioned proximate the lower edge and extending inwardly from the lower edge.

12. The cup holder of claim 11, wherein the first perforated element comprises a first perforation and a second perforation; and wherein the cup holder further comprises:

a second perforated element extending inwardly from the lower edge, the second perforated element comprising a third perforation and a fourth perforation.

13. The cup holder of claim 12, further comprising:

a first non-perforated section extending between the first perforation and the third perforation; and a second non-perforated section extending between the second perforation and the fourth perforation.

14. The cup holder of claim 12, wherein the first perforation the second perforation extend along a common plane, and wherein the third perforation the fourth perforation extend along a common plane.

15. The cup holder of claim 12, wherein the first perforation and the third perforation extend along a line which is substantially parallel to a first side of the handle, and the second perforation and the fourth perforation extend along a line which is substantially parallel to a second side of the handle.

16. The cup holder of claim 12, wherein the perforated element is tearable to adjust a configuration of the handle relative to the sleeve.

17. A cup holder, comprising:

a sleeve that is expandable from a flat position to an open position and configured to receive a cup, the sleeve comprising an upper edge and a lower edge;

a handle having first and second ends coupled to the sleeve proximate the upper edge and lower edge to form a loop;

a first perforated element positioned proximate the first perimeter and extending inwardly from the upper edge; and a second perforated element positioned proximate the second perimeter and extending inwardly from the lower edge.

18. The cup holder of claim 17, wherein each of the first and second perforated elements comprises a plurality of perforations that define edges of the associated portion of the upper and lower portions of the sleeve.

19. The cup holder of claim 17, wherein each of the first perforated element and the second perforated element are tearable to adjust a configuration of the handle relative to the sleeve.

20. The cup holder of claim 17, wherein the first perforated element comprises a first perforation and a second perforation; and wherein the cup holder further comprises:

a second perforated element extending inwardly from the lower edge, the second perforated element comprising a third perforation and a fourth perforation.

* * * * *